US006107978A

United States Patent [19]

Nagaoka et al.

[11] Patent Number: 6,107,978

[45] Date of Patent: Aug. 22, 2000

[54] PLASMA DISPLAY HAVING VARIABLE SCAN LINE PULSES TO REDUCE FLICKERING

[75] Inventors: Keishin Nagaoka; Kyoji Kariya; Naoki Matsui; Yoshikazu Kanazawa, all of Kawasaki, Japan

[73] Assignee: Fujitsu Limited, Kawasaki, Japan

[21] Appl. No.: 08/674,776

[22] Filed: Jun. 28, 1996

[30] Foreign Application Priority Data

Dec. 25, 1995 [JP] Japan ..... 7-336951

[51] Int. Cl.[7] ..... G09G 3/28; G09G 3/10; H01J 17/49

[52] U.S. Cl. ..... 345/60; 345/67; 315/169.4

[58] Field of Search ..... 345/60, 66, 67, 345/68, 208; 315/169.1, 169.2, 169.3, 169.4; 31/582, 594, 585

[56] References Cited

U.S. PATENT DOCUMENTS

| | | | |
|---|---|---|---|
| 4,692,665 | 9/1987 | Sakuma | 345/60 |
| 5,231,382 | 7/1993 | Tanaka | 345/60 |
| 5,739,799 | 4/1998 | Takahashi et al. | 345/68 |

*Primary Examiner*—Jeffery Brier
*Assistant Examiner*—David L Lewis
*Attorney, Agent, or Firm*—Greer, Burns & Crain, Ltd.

[57] ABSTRACT

A PDP driving method for more reliably lighting cells that should be lit has been disclosed. The pulse duration of a scanning pulse can be varied depending on a scan line. The pulse duration of a scanning pulse to be applied to a scan line, to which numerous cells each having a high probability of becoming a flickering missing point because a priming effect is unavailable or small are connected, is made longer than that of a scanning pulse to be applied to the other scan lines. When a cell connected to the same address line and to an immediately preceding scan line or a scan line preceding the immediately preceding scan line is unlit, the pulse duration of a scanning pulse to be applied to a cell concerned is made longer. When a whole panel is noted, a scanning pulse having a long pulse duration is applied at least to the first scan bus line. If possible, the scanning pulse having a long pulse duration is applied to the second and third scan lines. As for the other scan lines, since they are influenced by display data, it is judged on the basis of display data to be displayed during the next cycle prior to the next cycle if each cell has a high probability of an addressing discharge failure.

29 Claims, 24 Drawing Sheets

Fig.6

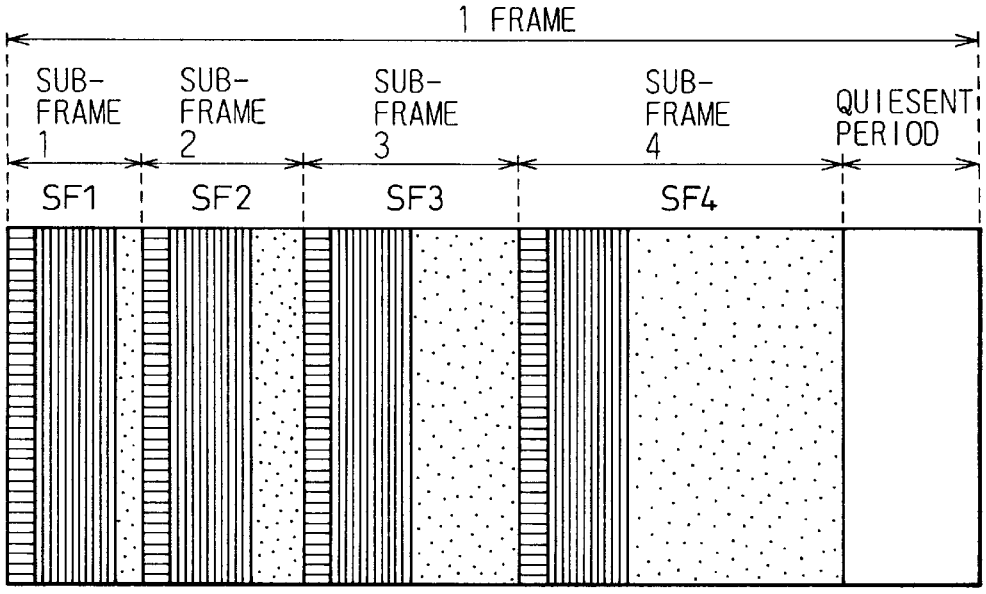

| | |
|---|---|
| FULL-SCREEN WRITING AND ERASING PERIOD (RESET PERIOD) | *WRITING DISCHARGE AND ERASING DISCHARGE ARE PERFORMED SIMULTANEOUSLY ON WHOLE SCREEN. |
| ADDRESSING PERIOD | *LINE-SEQUENTIAL WRITING DISCHARGE ADDRESSING IS PERFORMED TO SELECT DISPLAY CELLS FOR EACH SCAN LINE. |
| SUSTAINING PERIOD | *SUSTAINING DISCHARGE ALONE IS CARRIED OUT. ( RATIO OF SUSTAINING DISCHARGE PERIODS OF SUBFRAMES IS 1:2:4:8. ) |
| QUIESENT PERIOD | *NO DRIVING SIGNAL IS OUTPUT. (ALL ELECTRODES ARE SET TO 0V.) |

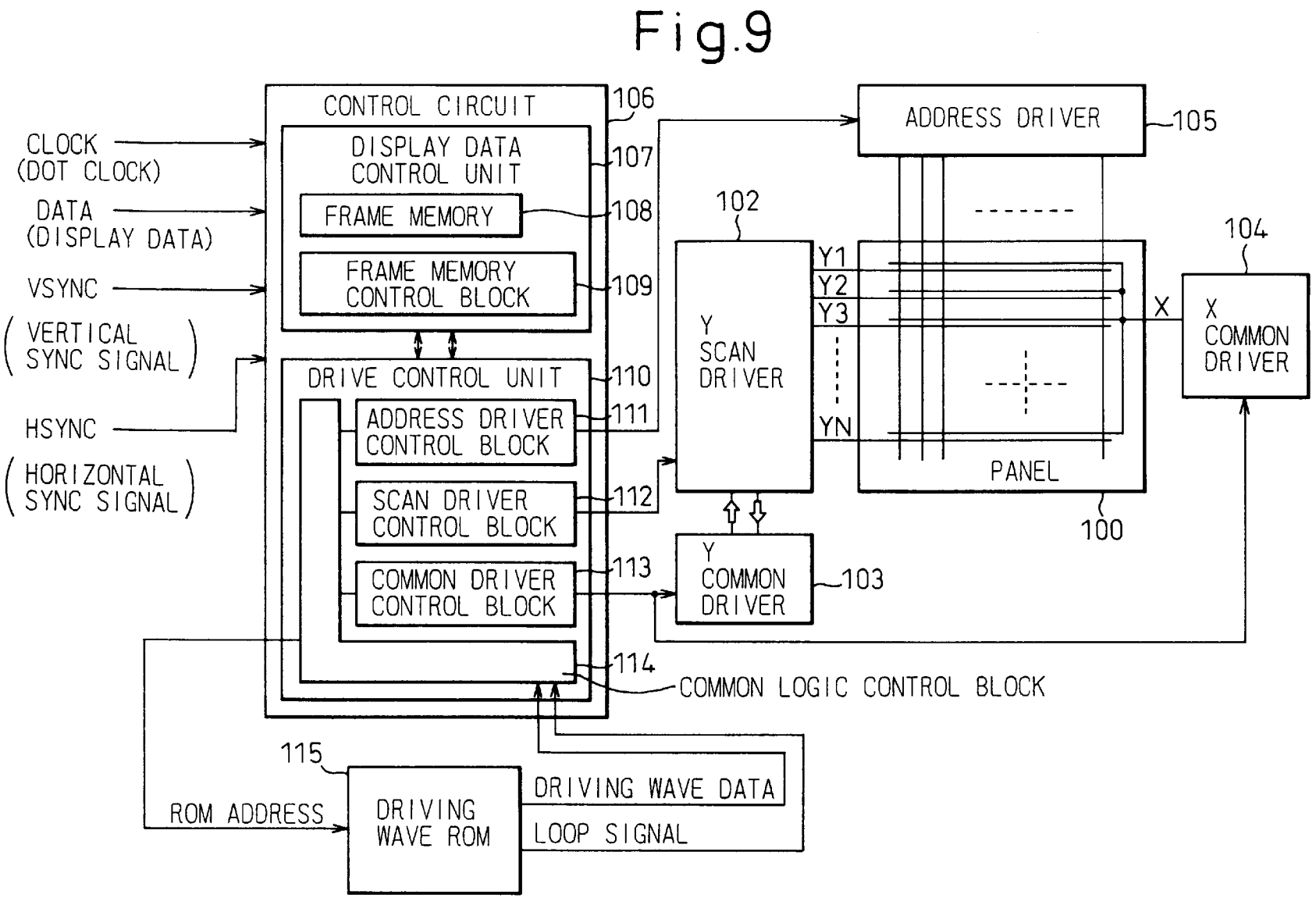
Fig.9
X COMMON DRIVER
104
105
ADDRESS DRIVER
X
100
PANEL
Y1
Y2
Y3
YN
102
Y SCAN DRIVER
103
Y COMMON DRIVER
COMMON LOGIC CONTROL BLOCK
106
107
108
109
110
111
112
113
114
CONTROL CIRCUIT
DISPLAY DATA CONTROL UNIT
FRAME MEMORY
FRAME MEMORY CONTROL BLOCK
DRIVE CONTROL UNIT
ADDRESS DRIVER CONTROL BLOCK
SCAN DRIVER CONTROL BLOCK
COMMON DRIVER CONTROL BLOCK
DRIVING WAVE DATA
LOOP SIGNAL
DRIVING WAVE ROM
115
ROM ADDRESS
CLOCK (DOT CLOCK)
DATA (DISPLAY DATA)
VSYNC
VERTICAL SYNC SIGNAL
HSYNC
HORIZONTAL SYNC SIGNAL

INFLUENCE OF CELL LYING UPSTREAM OF SCANNING

INFLUENCE OF STATE DURING IMMEDIATELY PREVIOUS SUBFRAME

| SCAN LINE | NUMBER OF AF-PRONE CELLS ◌ nAF[CELLS] |
|---|---|
| SCAN LINE 1 | 0 |
| SCAN LINE 2 | 0 |
| SCAN LINE 3 | 4 |
| SCAN LINE 4 | 0 |

PLASMA DISPLAY HAVING VARIABLE SCAN LINE PULSES TO REDUCE FLICKERING

BACKGROUND OF THE INVENTION

1. Field of the Invention

The present invention relates to a driving method for a plasma display panel (hereinafter a PDP) and to a plasma display (PDP display). More particularly, this invention is concerned with a PDP driving method for improving display quality and a PDP display permitting improved display quality.

2. Description of the Related Art

In recent years, there have been great demands for diversified information to be displayed, for varied conditions for installation, for larger screen sizes, and for higher definition in the field of displays. The advent of a display meeting these demands has been awaited. Displays currently used in practice include various types of displays; a CRT, LCD, EL, fluorescent character display, light-emitting diode, and the like. PDP displays are drawing attention because of their excellent properties; no flicker, ease in making the screen larger, high luminance, long service life, and the like.

In the displays, needless to say, it is required to improve the display quality. Even in the PDP display, a further improvement in display quality is demanded.

PDP are available as a dual-electrode type in which two kinds of electrodes are used for selective discharge (addressing discharge) and sustaining discharge, and as a triple-electrode type in which the third electrode is used for addressing discharge. In a color PDP capable of gradational display, phosphors formed in discharge cells are excited by ultraviolet rays stemming from an electrical discharge. The phosphor has a drawback in that it is susceptible to the impact of ions that are positive charges stemming from a discharge. Since the dual-electrode type adopts the structure in which the phosphors are hit directly by ions, the ions may decrease the service life of each phosphor. To avoid this, the color PDP usually adopts the triple-electrode structure using surface discharge. Furthermore, the triple-electrode type is sub-divided into a type in which the third electrode is formed on a substrate on which the first and second electrodes responsible for sustaining discharge are arranged, and a type in which the third electrode is mounted on another substrate opposed to the substrate on which the first and second electrodes are arranged. Moreover, visible light emanating from a phosphor may be seen to be transmitted by the phosphor (transparent type) or to be reflected from the phosphor (reflective type). Moreover, the spatial coupling of each cell to be discharged to adjoining cells is disconnected by means of ribs or barriers. The ribs or barriers may be placed in four positions so that a discharge cell can be surrounded by ribs or barriers. Alternatively, the rib or barrier may be placed only on one side of a cell, and the coupling of the cell on the other sides are disconnected by optimizing the gaps (distances) between electrodes.

The present invention can apply to a plasma display panel (PDP) of any of the foregoing types, and relates to a driving method for any type of PDP and to a plasma display having the PDP. The present invention can thus apply to any kind of configuration. Herein, a description will be made by taking as an example a reflective type panel in which the third electrode is formed on another substrate opposed to a substrate containing electrodes responsible for sustaining discharge, in which a rib or barrier is formed only in a vertical direction (that is, ribs or barriers are orthogonal to the first electrode and second electrode and parallel to the third electrode), and in which part of each sustaining electrode is formed with a transparent electrode.

Gray-scale display in a plasma display is such that: one display frame is divided into a plurality of subframes having different lengths; bits of display data are associated with the subframes; and the lengths of the subframes are changed according to weights applied to the associated bits. One subframe is divided into a reset period, addressing period, and sustaining discharge period. During the reset period, a full-screen writing pulse is applied. All cells constituting all display lines are discharged irrespective of the preceding states of display. This is self-erasure discharge. The self-erasure discharge brings all the cells in a panel to a uniform state devoid of a wall charge. The reset period brings all the cells to the same state irrespective of the lit or unlit states of the cells during the previous subframe. The reset period is used to achieve the following addressing (writing) discharge on a stable basis.

During the addressing period, addressing discharge is carried out line-sequentially in order to turn on or off the cells according to display data. A scanning pulse is applied to a Y electrode. An addressing pulse is applied selectively to address electrodes of all address electrodes which coincide with cells to be lit. Consequently, discharge occurs between the address electrodes and Y electrode which specify the cells to be lit. With this discharge as a primer, discharge occurs between an X electrode and the Y electrode. Wall charges each having a magnitude permitting sustaining discharge are then accumulated on the surface over the X and Y electrodes. The same operation is performed sequentially on the other display lines. New display data is thus written on all the display lines.

Thereafter, during the sustaining discharge period, a sustaining pulse is applied alternately to the Y electrodes and X electrode. Sustaining discharge is then carried out. An image for one subframe is thus displayed. In this "addressing/sustaining discharge separated writing addressing method," a luminance is determined by the length of the sustaining discharge period; that is, the number of sustaining pulses.

In a driving method for a plasma display, addressing discharge, which is discharge to be performed according to display data, is carried out. A necessary and sufficient addressing discharge time (pulse duration of a scanning pulse) is varied depending on the lit or unlit conditions of cells that are located adjacently and that have been subjected to addressing discharge previously.

This is because when discharge has been performed at adjacent locations previously, intended addressing discharge is achieved rapidly and reliably. This is referred to as a priming effect. For example, when a scan is carried out line-sequentially from the top (first scan line) of a panel to the bottom (m-th scan line) thereof, a necessary and sufficient addressing discharge time for the n-th scan line depends greatly on the selected or unselected states of cells connected to the n−1-th or n−2-th scan line. In other words, when the priming effect is exerted because addressing discharge is performed on a preceding scan line or a scan line preceding the preceding scan line, a short pulse duration will do. However, when the priming effect is not exerted, a long pulse duration is needed. When the pulse duration of a scanning pulse does not meet a necessary and sufficient pulse duration, the probability of imperfect addressing discharge gets higher. In practice, cells that must be lit flicker or do not light. This leads to a marked deterioration in display quality.

In order to prevent the foregoing problem, the pulse duration of a scanning pulse should be made longer. However, the time allotted to addressing discharge is limited in terms of display speed. This measure cannot therefore be adopted it is possible that cells that must be lit flicker or do not light. This poses a problem in display quality.

SUMMARY OF THE INVENTION

An object of the present invention is to solve the foregoing problem and to realize a PDP driving method for lighting cells, which must be lit, more reliably and to realize a PDP display in which it is unlikely that cells that must be lit flicker or do not light.

In the PDP driving method and PDP display in accordance with the present invention, the pulse duration of a scanning pulse can be varied depending on a scan line. The pulse duration of a scanning pulse to be applied to a scan line, to which numerous cells, each having a high probability of flickering or not lighting because a priming effect is unavailable or small, are connected, is made longer than the pulse duration of a scanning pulse to be applied to the other scan lines.

It is difficult to determine to which scan line a scanning pulse having a long pulse duration should be applied and what should be the pulse duration. Several modes are conceivable in terms of this problem. As mentioned above, as far as a cell connected to the n-th scan line is concerned, if another cell connected to the same address line and to the n−1-th or n−2th scan line (a scan line immediately above the n-th scan line or a scan line above the immediately above scan line) is unlit, the duration of a scanning pulse must be long. If the cell connected to the n−1-th or n−2-th scan line is lit, a scanning pulse having a relatively short pulse duration can enable discharge.

Herein, when the whole panel is considered, if the priming effect influences a plurality of scan lines, a scan line to be scanned last will undergo the priming effect most greatly. For example, when the whole panel is lit, all scan lines except the first scan line undergo the priming effect exerted by the preceding scan lines. Compared with the cells connected to the first scan line, cells connected to scan lines other than the first scan line have a very small probability of causing imperfect addressing discharge. In other words, since the first scan line has no preceding scan line, addressing discharge does not occur previously irrespective of a display pattern. The first scan line does not undergo the priming effect. Compared with the other scan lines, the first scan line therefore has a high probability of imperfect addressing discharge. As for the second scan line, if addressing discharge on the first scan line fails, since no priming is induced by the first scan line, the second scan line has a high probability of imperfect addressing discharge, though the probability is not so high as that of the first scan line. The same applies to the third scan line.

In the present invention, a scanning pulse having a longer pulse duration than one to be applied to scan bus lines to be scanned later is applied to scan bus lines to be scanned initially. In particular, a scanning pulse having a long pulse duration is applied at least to the scan bus line to be scanned first. If possible, the scanning pulse having a long pulse duration is also applied to the second and third scan lines. This kind of scanning pulse extension method shall be referred to as initial scanning pulse extension. In this case, a scanning pulse whose pulse duration is extended is a scanning pulse to be applied to one or several scan lines. An increase in total driving time is therefore very small. Even if the long pulse duration of a scanning pulse may be constant, no problem occurs. The long pulse duration of a scanning pulse ranges from a 1.05 times multiple of a normal short pulse duration to a 4 times multiple thereof, and is preferably about 2.3 times longer than the short pulse duration.

As mentioned above, the first scan line through the second or third scan line have a high probability of causing imperfect addressing discharge. The other scan lines are influenced by display data. As mentioned above, a scanning pulse having a long pulse duration cannot be applied to all scan lines because of a temporal restriction. The scanning pulse having a long pulse duration can be applied to several tens of scan lines. In the present invention, it is judged on the basis of display data to be displayed during the next cycle, prior to the next cycle if each cell has a high probability of an addressing discharge failure. A total number of cells having a high probability of an addressing discharge failure per scan line is calculated. Scan lines to which a scanning pulse having a long pulse duration is applied are selected from among the scan lines associated with large total numbers of such cells. This method of extending the pulse duration of a scanning pulse to be applied to arbitrary scan lines according to a display pattern is referred to as arbitrary scanning pulse duration extension.

The criteria for judging that each cell has a high probability of an addressing discharge failure are that a cell connected to the same address line and to a scan line that is scanned immediately previously is unlit, that a cell concerned is unlit during an immediately previous cycle, and that the two conditions are met.

As for scan lines to which a scanning pulse having a long pulse duration is applied, (a) the number of scan lines to which a scanning pulse having a long pulse duration is applied is determined in advance, and the determined number of scan lines are selected in descending order of total number of cells having a high probability of an addressing discharge failure and (b) when the number of scan lines that are associated with total numbers of cells having a high probability of an addressing discharge failure, which are larger than or equal to a given value, is larger than a given value, the number of scan lines are selected in descending order of total number of cells having a high probability of an addressing discharge failure in the same manner as those in case of (a). When the number of such scan lines falls below the given value, the scan lines associated with total numbers of cells having a high probability of a failure, which are larger than or equal to the given value, are selected as scan lines to which a scanning pulse having a long pulse duration is applied, and the long pulse duration is determined according to the number of scan lines. Otherwise, (c) the scan lines associated with total numbers of cells having a high probability of an addressing discharge failure, which are larger than or equal to the given value, are selected as scan lines to which a scanning pulse having a long pulse duration is applied, and the long pulse duration is determined according to the number of scan lines.

Owing to the foregoing arbitrary scanning pulse duration extension, imperfect addressing discharge can be minimized effectively according to a display pattern.

A long pulse duration of a scanning pulse can be set to any value for each display. Furthermore, when the number of scan lines to which a long scanning pulse is applied varies, the long pulse duration of a scanning pulse must be able to be set arbitrarily for each scan line.

BRIEF DESCRIPTION OF THE DRAWINGS

The present invention will be more clearly understood from the description as set below with reference to the accompanying drawings, wherein:

FIG. 6 is a timing chart concerning the addressing/sustaining discharge separated addressing method enabling a PDP to perform gray-scale display;

FIG. 9 is a diagram showing the overall configuration of a PDP of the first embodiment of the present invention;

DESCRIPTION OF THE PREFERRED EMBODIMENTS

Before proceeding to a detailed description of the preferred embodiments of the present invention, a conventional plasma display apparatus will be described to allow a clearer understanding of the differences between the present invention and the prior art.

In the embodiments described below, a description will be made by taking for instance a PDP in which a scan is executed line-sequentially from the top (first scan line) of a plasma display panel to the bottom (480th scan line) thereof.

Figure 1:
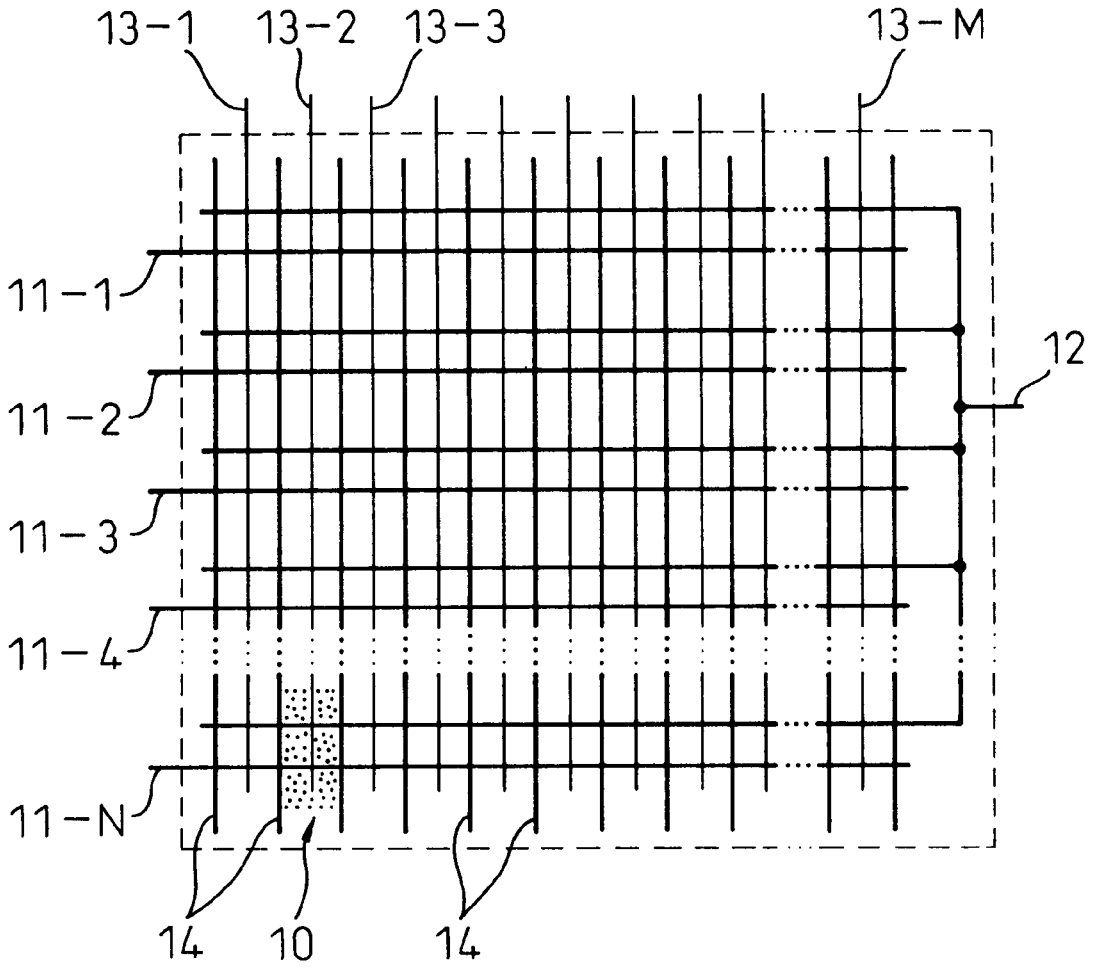
FIG. 1 is a schematic plan view of a triple-electrode surface-discharge AC type PDP.
Figure 2:
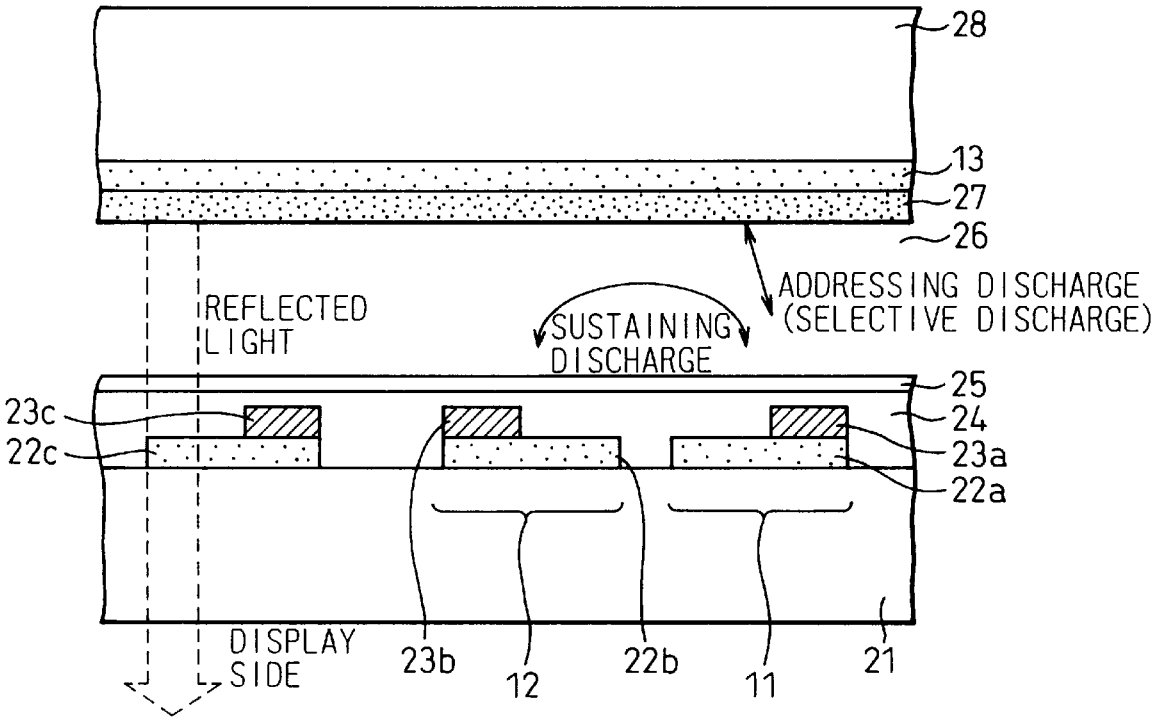
FIG. 2 is a schematic sectional view of the triple-electrode surface-discharge AC type PDP.
Figure 3:
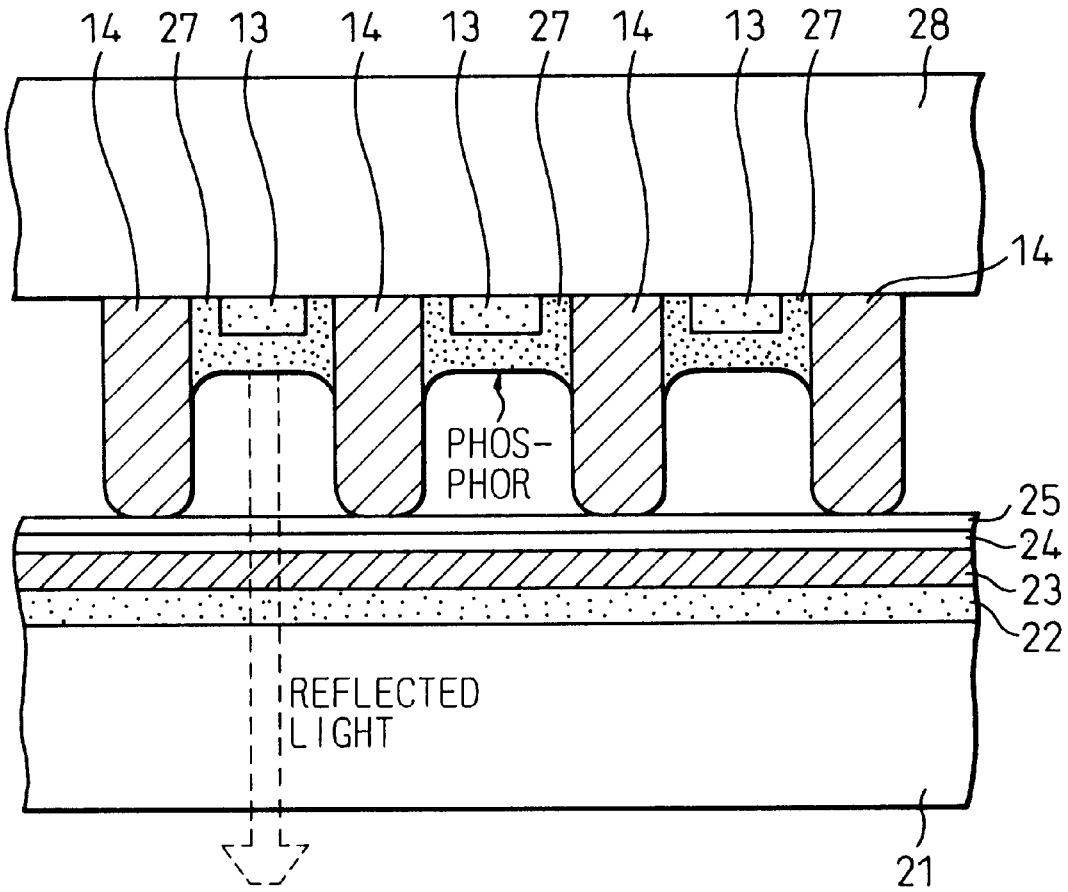
FIG. 3 is a schematic sectional view of the triple-electrode surface-discharge AC type PDP.

As the foregoing triple-electrode surface-discharge PDP, a PDP whose schematic plan view is shown as FIG. 1 is well-known. FIG. 2 is a schematic sectional view (vertical direction) of one discharge cell in the panel shown in FIG. 1. FIG. 3 is a schematic sectional view showing the discharge cell in a horizontal direction. In the drawings referred to below, the same functional components are assigned the same reference numerals.

A panel is composed of two glass substrates 21 and 29. The first substrate 21 has a first electrode (X electrode) 12 and second electrode (Y electrodes) 13 which are mutually-parallel sustaining electrodes. These electrodes are formed with transparent electrodes 22*a* and 22*b* and bus electrodes 23*a* and 23*b*. A transparent electrode is formed with an ITO (a transparent conducting membrane made mainly of indium oxide) or the like in order to fill the role of transmitting light from a phosphor. A bus electrode must be formed to have a low resistance in order to prevent a voltage drop due to an electric resistance, and is therefore made of chrome (Cr) or copper (Cu). The transparent electrodes and bus electrodes are covered with a dielectric layer (glass) 24. An MgO (magnesium oxide) membrane 25 is formed as a protective membrane on the discharge side of the dielectric layer. On the second substrate 29 opposed to the first glass substrate 21, a third electrode (address electrodes) 13 is formed so that the address electrodes will be orthogonal to the sustaining electrodes. A barrier 14 is formed between the address electrodes. A phosphor 27 having a property of glowing in red, green, and blue is formed between barriers in such a manner that the phosphor shields an address electrode. The two glass substrates are assembled so that the ridges of the barriers 14 will come into close contact with the MgO surface 25. Spaces created between the phosphors 27 and MgO surface 25 are discharge spaces 26.

Figure 4:
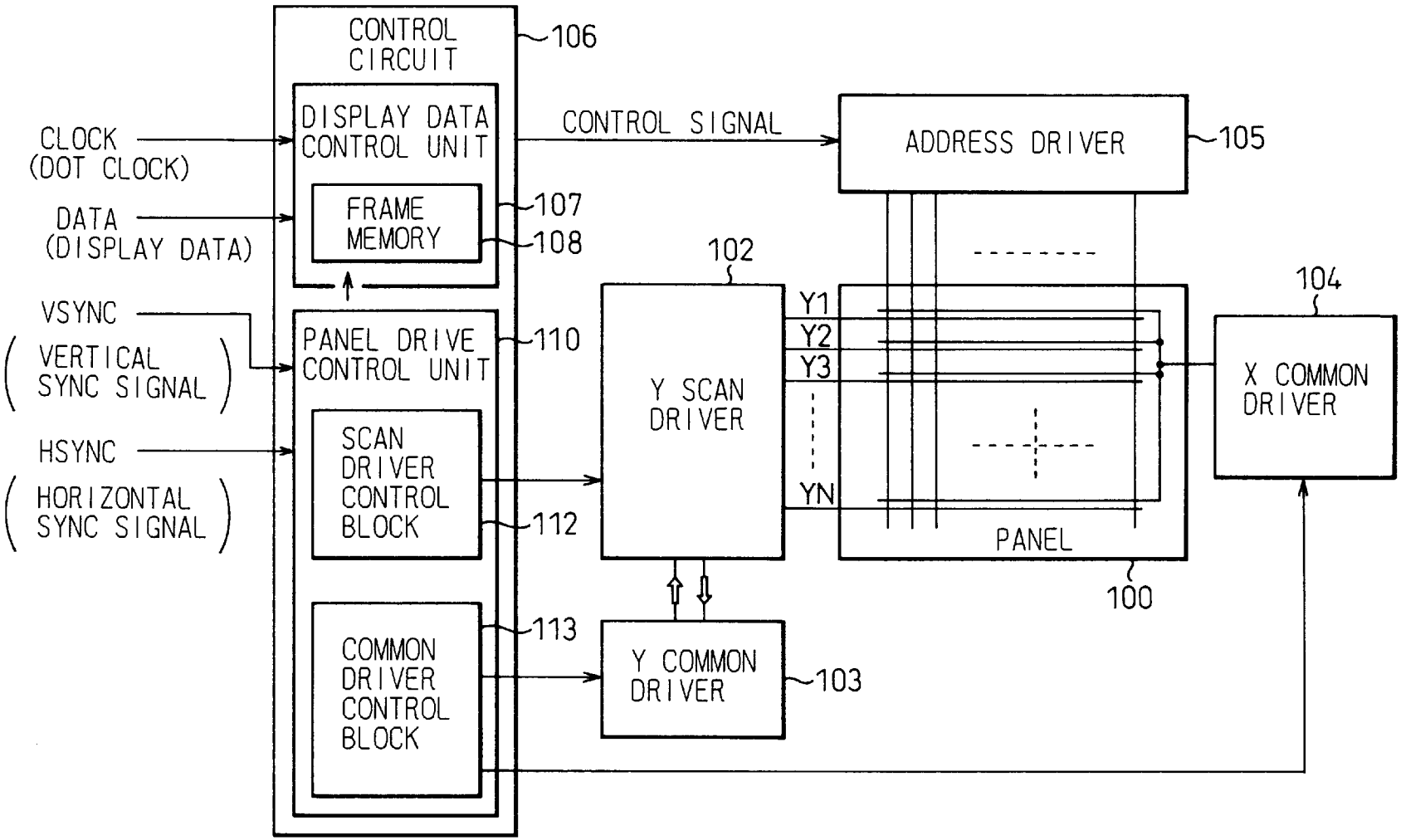
FIG. 4 is a block diagram of drive circuits for the triple-electrode surface-discharge AC type PDP.

FIG. 4 is a schematic block diagram showing peripheral circuits for driving the PDP shown in FIGS. 1 to 3. The address electrodes 13-1, 13-2, etc. are connected to an address driver 105 one by one. The address driver applies an addressing pulse during an addressing discharge period. The Y electrodes 11-1, 11-2, etc. are connected to a Y driver 101. The Y driver 101 is composed of a Y scan driver 102 and Y common driver 103. The Y electrodes are connected independently to the Y scan driver 102. The Y scan driver 102 is connected to the Y common driver 103. A pulse to be applied during addressing discharge is generated by the Y scan driver 102. A sustaining pulse or the like is generated by the Y common driver 103, and applied to the Y electrodes by way of the Y scan driver 102. The X electrode 12 is connected in common to all display lines in the panel. An X common driver 104 generates a writing pulse, a sustaining pulse, and the like. These driver circuits are controlled by a control circuit. The control circuit is controlled by synchronizing (hereinafter sync) signals and a display data signal which are input to the display.

A gray-scale display in a PDP is usually such that bits of display data are associated with subframes, and the lengths of the subframes are made mutually different according to the weights applied to the bits. For a 256-level gray-scale display, for example, display data is expressed as eight bit bytes. One frame is displayed during eight subframes. Data items expressed by the eight bit bytes are displayed during the respective subframes. The ratio of the lengths of the subframes is 1:2:4:8:16:32:64:128.

Figure 5:
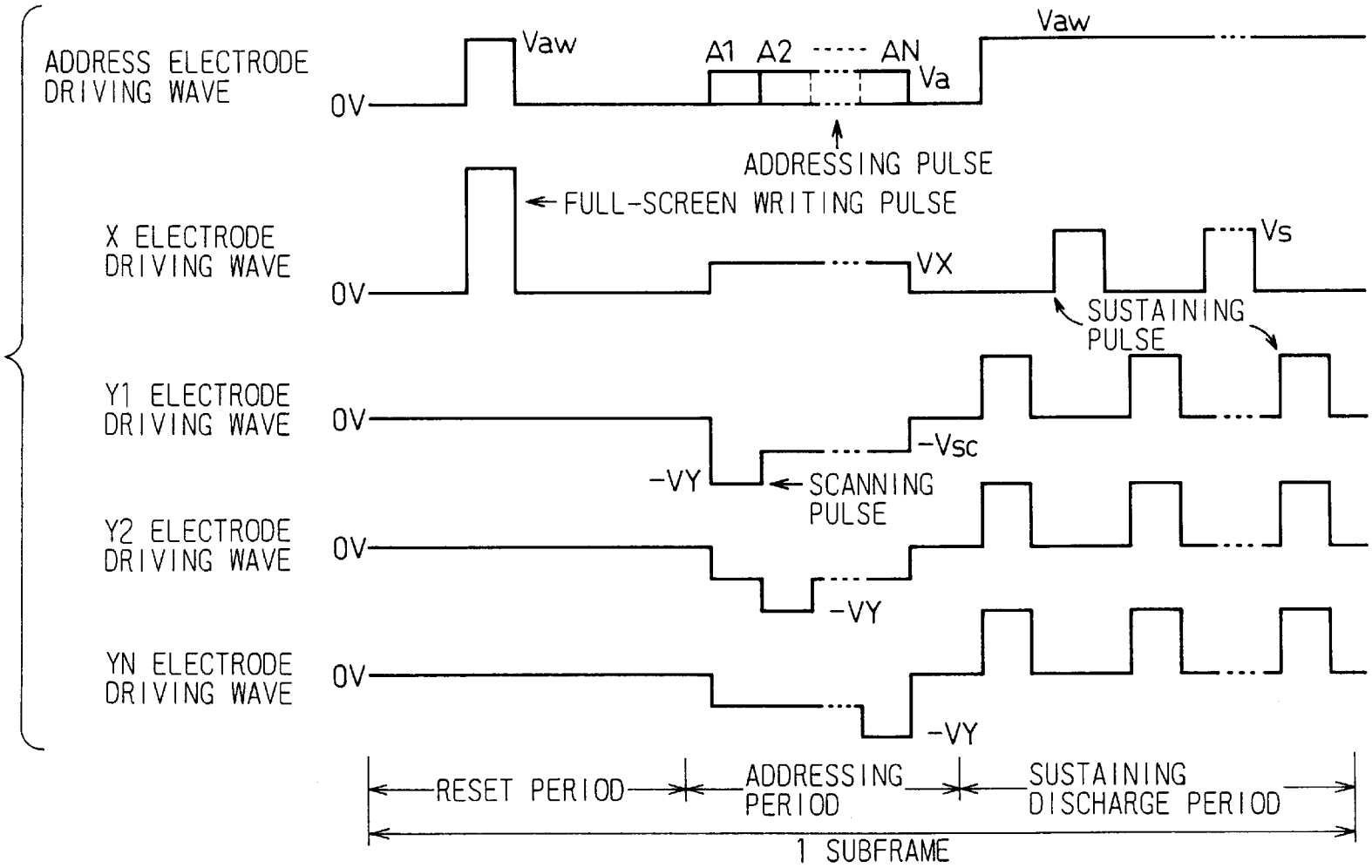
FIG. 5 is a diagram showing known driving waveforms.

FIG. 5 is a waveform diagram concerning a known method for driving the PDP shown in FIGS. 1 to 3 using the circuits shown in FIG. 4. FIG. 5 shows one subframe in the so-called known "addressing/sustaining discharge separated writing addressing method." In this example, one subframe is divided into a reset period, an addressing period, and a sustaining discharge period. During the reset period, all the Y electrodes are set to a 0-V level. At the same time, a full-screen writing pulse that is a voltage Vs+Vw (approximately 330V) is applied to the X electrode. All the cells constituting all the display lines are discharged irrespective to the previous states of display. The potentials at the address electrodes are approximately 100V (Vaw). Thereafter, the potentials at the X electrode and address electrodes are set to 0V. The voltages of the wall charges themselves in all the cells exceed a discharge start voltage, whereby discharge is started. This discharge is a so-called self-erasure discharge that saturates by itself and then ceases. Owing to the self-erasure discharge, all the cells in the panel are brought to a uniform state devoid of a wall charge. The reset period exerts the operation of bringing all the cells to the same state irrespective of the lit or unlit states of the cells during the previous subframe, and is used to achieve the next addressing (writing) discharge on a stable basis.

Thereafter, during the addressing period, addressing discharge is carried out line-sequentially in order to turn on or off the cells according to display data. First, a scanning pulse of −VY level (approximately −150V) is applied to a Y electrode. An addressing pulse of a voltage Va (approximately 50V) is applied selectively to the address electrodes coincident with cells to be lit, whereby discharge occurs between the address electrodes and Y electrode which specify the cells to be lit. With this discharge as a primer, discharge occurs between the X electrode (voltage Vx=50V) and Y electrode. Consequently, wall charges each having a magnitude permitting sustaining discharge are accumulated on the MgO surface over the electrodes. Hereinafter, the same operation is performed on the other display lines. Eventually, new display data is written on all the display lines.

Thereafter, when the sustaining discharge period starts, a sustaining pulse of a voltage Vs (approximately 180V) is applied alternately to the Y electrodes and X electrode. Sustaining discharge is then carried out. An image for one subframe is then displayed. In this case, a voltage Vaw of approximately 100V is applied to the address electrodes in order to avoid discharge occurring between the address electrodes and X electrode or Y electrodes.

In the "addressing/sustaining discharge separated writing addressing method," a luminance is determined with the length of a sustaining discharge period; that is, the number of sustaining pulses.

A driving method adopted for 16-level gray-scale display or an example of multilevel gray-scale display is shown in FIG. 6. In this example, one frame is segmented into four subframes; SF1 to SF4.

In the subframes SF1 to SF4, reset periods and addressing periods have the same lengths respectively. The ratio of the lengths of sustaining discharge periods is 1:2:4:8. Differences in luminance corresponding to 16 gray-scale levels of 0 to 15 can be displayed by selecting any of the subframes during which cells are lit.

As illustrated, the subframes SF1 to SF4 within each frame are followed by a quiescent period during which no driving wave is output.

In a driving method for a plasma display, for achieving addressing discharge that is discharge performed according to display data, a necessary and sufficient addressing discharge time (pulse duration of a scanning pulse) varies depending on the lit or unlit conditions of cells that are located adjacently and that are subjected to addressing discharge temporally previously.

This is because when discharge has previously occurred at adjacent locations, intended addressing discharge is achieved rapidly and reliably. This is referred to as a priming effect. For example, when scan is executed line-sequentially from the top (first scan line) of the panel to the bottom (m-th scan line) thereof, a necessary and sufficient addressing discharge time for the n-th scan line varies greatly depending on the selected or unselected states of cells connected to the n−1-th or n−2-th scan line. Table 1 lists examples of necessary times.

TABLE 1

| Scanning pulse duration | |
|---|---|
| Condition | Necessary and sufficient scanning pulse duration |
| Cells connected to the n-1-th or n-2-th scan-line are lit | 3 (us) |
| Cells connected to the n-1-th or n-2-th scan line are unlit | 4 to 8 (us) |

In the examples listed in Table 1, when cells connected to the n−1-th or n−2-th scan line are lit; that is, when the priming effect is exerted due to addressing discharge occurring in a preceding line or a line preceding the preceding line, a short pulse duration of about 3 microseconds will do. When the priming effect is not exerted, a long pulse duration ranging from 4 to 8 microseconds is needed.

When the pulse duration of a scanning pulse does not meet a necessary and sufficient pulse duration, the probability of causing imperfect addressing discharge rises. More particularly, cells to be lit become flickering missing points. This leads to a marked deterioration of the display quality.

In order to prevent occurrence of the foregoing problem, the pulse duration of a scanning pulse should be set to 8 microseconds all the time. However, the time allotted to addressing discharge is limited in terms of display speed. The above measure cannot therefore be adopted. Assuming that the number of gray-scale levels is 256 and a horizontal resolution is 480 scanning lines, a vertical sync period lasts 16.7 milliseconds. Assuming that a sustaining discharge period and other periods need 4 milliseconds, a total addressing discharge time comes to 12.7 milliseconds. 256-level gray-scale display needs eight subframes. An addressing discharge time per subframe is therefore 1.59 milliseconds. Since 480 scans are executed during subframe SF1, the pulse duration of one scanning pulse is 3.3 microseconds. Thus, when the number of gray-scale levels is 256 and a horizontal resolution is 480 scanning lines, the pulse duration of a scanning pulse cannot be set to 3.3 microsecond or longer because of a temporal restriction. Therefore a certain probability that cells to be lit become flickering missing points occurs. This poses a problem in display quality.

FIG. 9 is a diagram showing the overall configuration of a triple-electrode AC type PDP display (plasma display) of the first embodiment of the present invention.

In FIG. 9, reference numeral 100 denotes a plasma display panel. 101 denotes a Y driver. 102 denotes a Y scan driver. 103 denotes a Y common driver. 104 denotes an X common driver. 105 denotes an address driver. 106 denotes a control circuit. 107 denotes a display data control unit. 108 denotes a frame memory. 109 denotes a frame memory control block. 110 denotes a drive control unit. 111 denotes an address driver control block. 112 denotes a scan driver control block. 113 denotes an X common driver control block. 114 denotes a common logic control block. 115 denotes a driving wave ROM. The PDP display has the same configuration as a known display except a point that the scan driver control block 112 produces and supplies a control signal so as to enable the Y scan driver 102 to output a scanning pulse whose pulse duration varies depending on a scan line. The difference alone will be described below.

The driving pattern ROM 115 stores various kinds of pattern data used to determine the waveform of a driving wave to be applied to electrodes. When a vertical sync signal Vsync is input to the display, the common logic control block 114 gives a corresponding address signal to the driving pattern ROM 115 so as to read driving wave data and a loop signal. The common logic control block 114 controls the address driver control block 111, scan driver control block 112, and common driver control block 113 according to the data, then enters an idle period, and stands by until the next Vsync is input. The above sequence realizes driving based on the contents of the driving wave pattern ROM.

Figure 7:
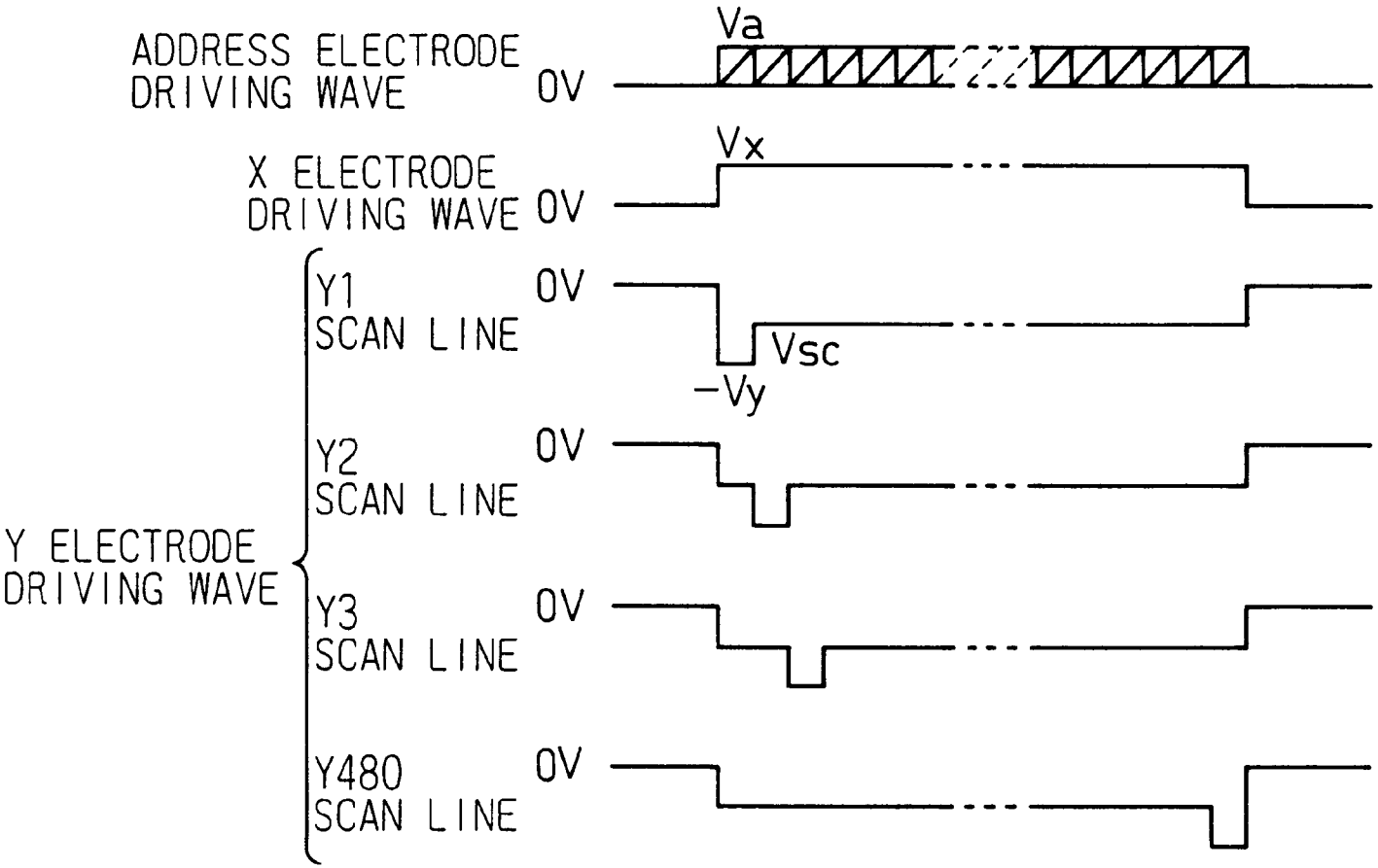
FIG. 7 is a detailed diagram of driving waveforms to be applied during an addressing period in an known display.
Figure 10:
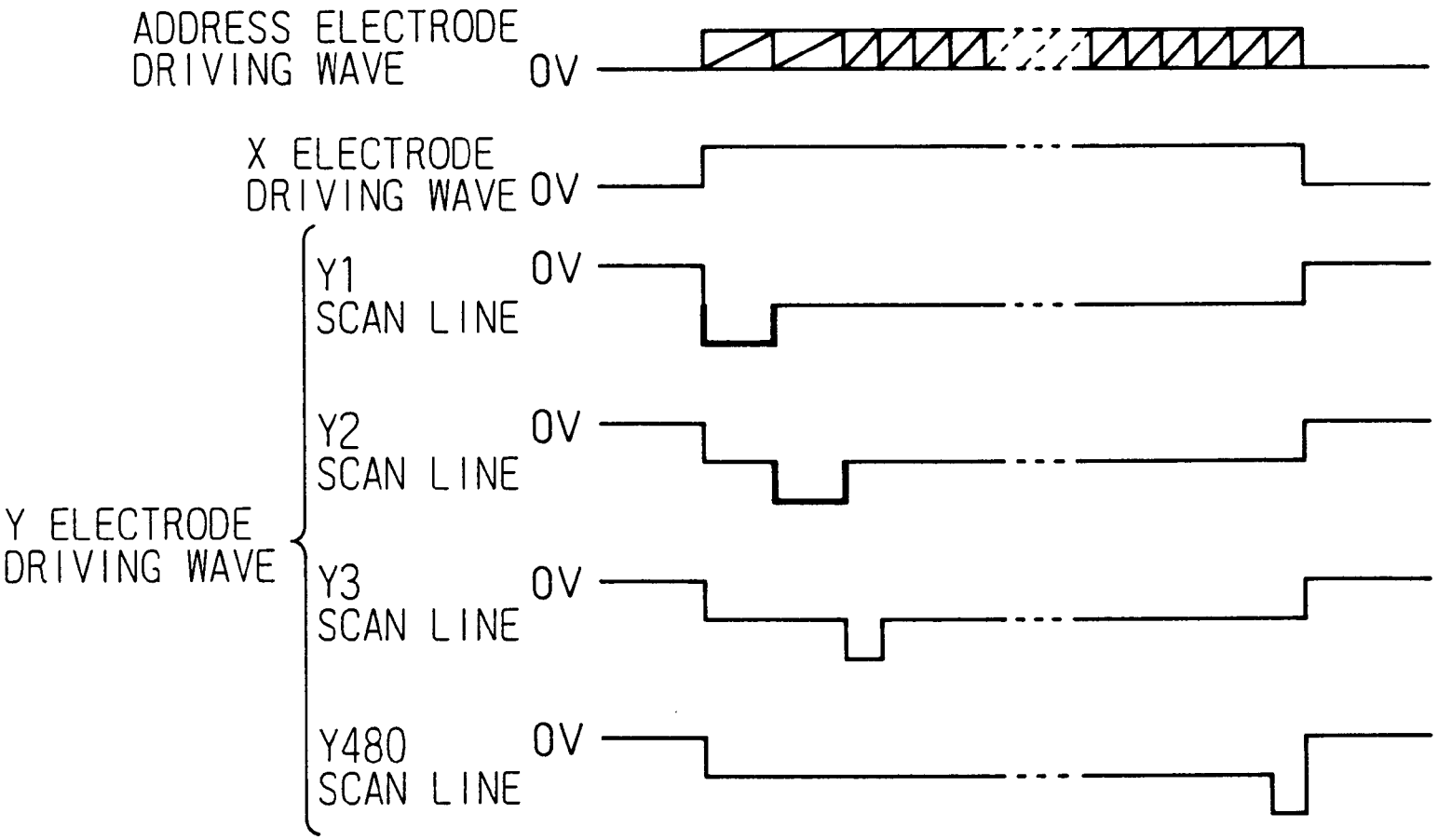
FIG. 10 is a detailed diagram of driving waveforms to be applied during an addressing period in the first embodiment.

FIG. 10 is a diagram showing in detail an addressing period driving waveform employed in this embodiment. FIG. 7 is a diagram showing in detail an addressing period driving wave employed in the known display for explanation of a difference from this embodiment.

These drawings are diagrams detailing the addressing period shown in the driving waveform diagram of FIG. 5. In the known display, when the pulse duration of a scanning pulse to be applied to the scan lines Y1, Y2, Y3, etc. and Y480 is noted, as shown in FIG. 7, the prior art fixes the pulse duration at the same value. As mentioned above, several scan lines with which a scan is started, especially, the first scan line, has a higher probability of imperfect addressing discharge than the other scan lines. By contrast, in this embodiment, as shown in FIG. 10, the pulse duration of a scanning pulse to be applied to the scan lines Y1 and Y2 is longer than that of a scanning pulse to be applied to the other scan lines. This enables to minimize the probability of imperfect addressing discharge occurring on several scan lines with which a scan is started. In the present invention, the method for extending the pulse duration of a scanning pulse to be applied to several scan lines with which a scan is started is referred to as initial scanning pulse extension.

Next, the driving wave pattern ROM 115 and actual loop repeating operations will be described.

Figure 8:
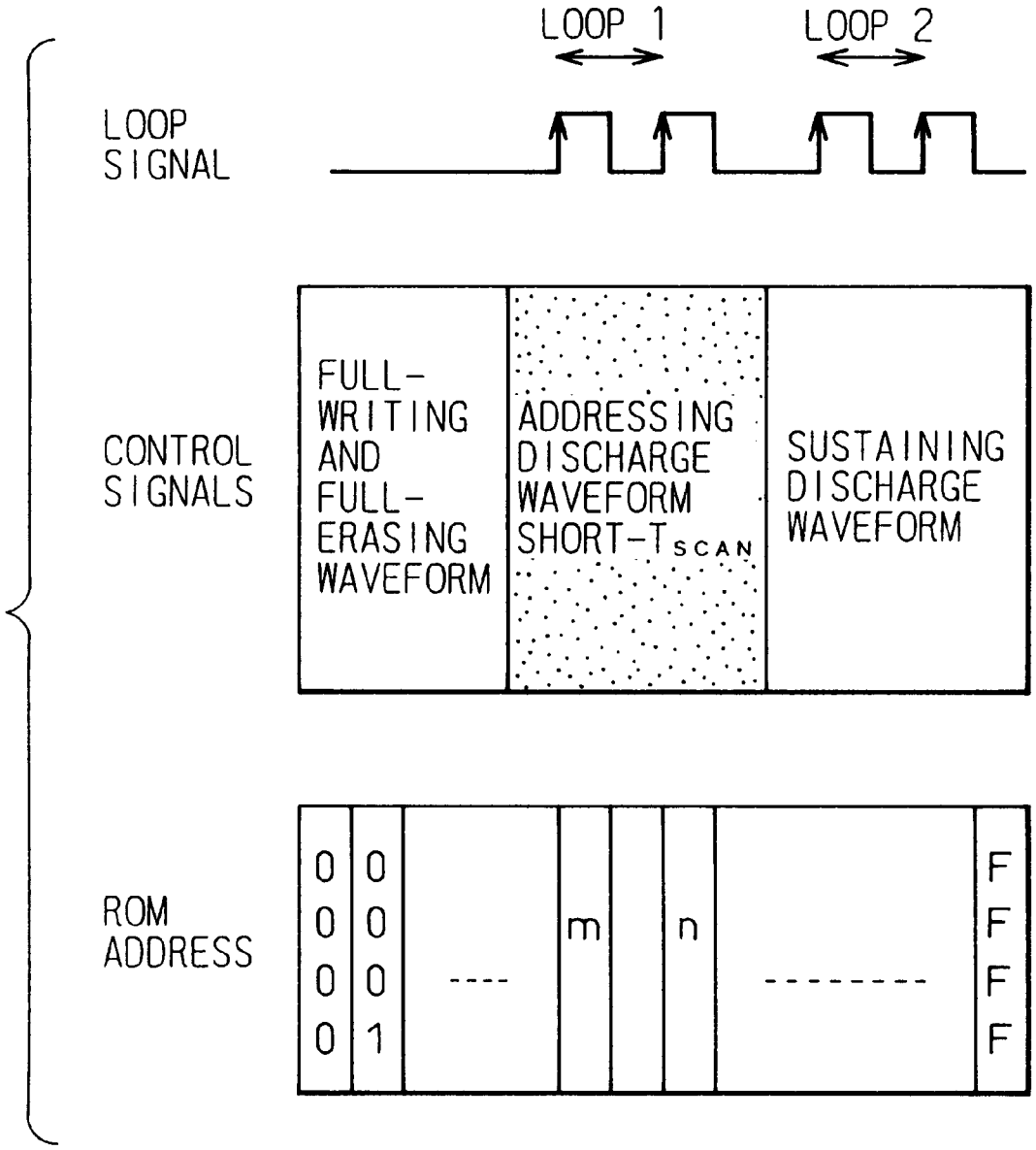
FIG. 8 is a diagram showing the relationship between the contents of a driving waveform ROM and a loop signal which are employed in the known display.

To begin with, the contents of the driving wave ROM 115 and a loop signal which are employed in the known display will be described with reference to FIG. 7. An addressing discharge driving waveform assumes the same waveform relative to all scan lines from the first scan line to the 480th scan line. One scanning pulse pattern short-Tscan alone is stored in the driving waveform ROM 115. The pattern is repeated by a required number of times according to a loop signal. The number of loops is stored and set in advance in the common logic control unit 114. According to the prior art, a loop is repeated 480 times. More particularly, in FIG. 8, a pattern used for full-screen writing and full-screen erasing, which is stored in an area from address 0 to m−1 in the driving waveform ROM 115, is read in order to produce a pulse to be applied to the address electrodes, X common electrode, and Y scan electrodes. Thereafter, an area from address m to n is read repeatedly 480 times in order to produce a scanning pulse to be applied to the scan lines. An area from address n+1 to the last address is then read in order to produce a pulse used for sustaining discharge.

Figure 11:
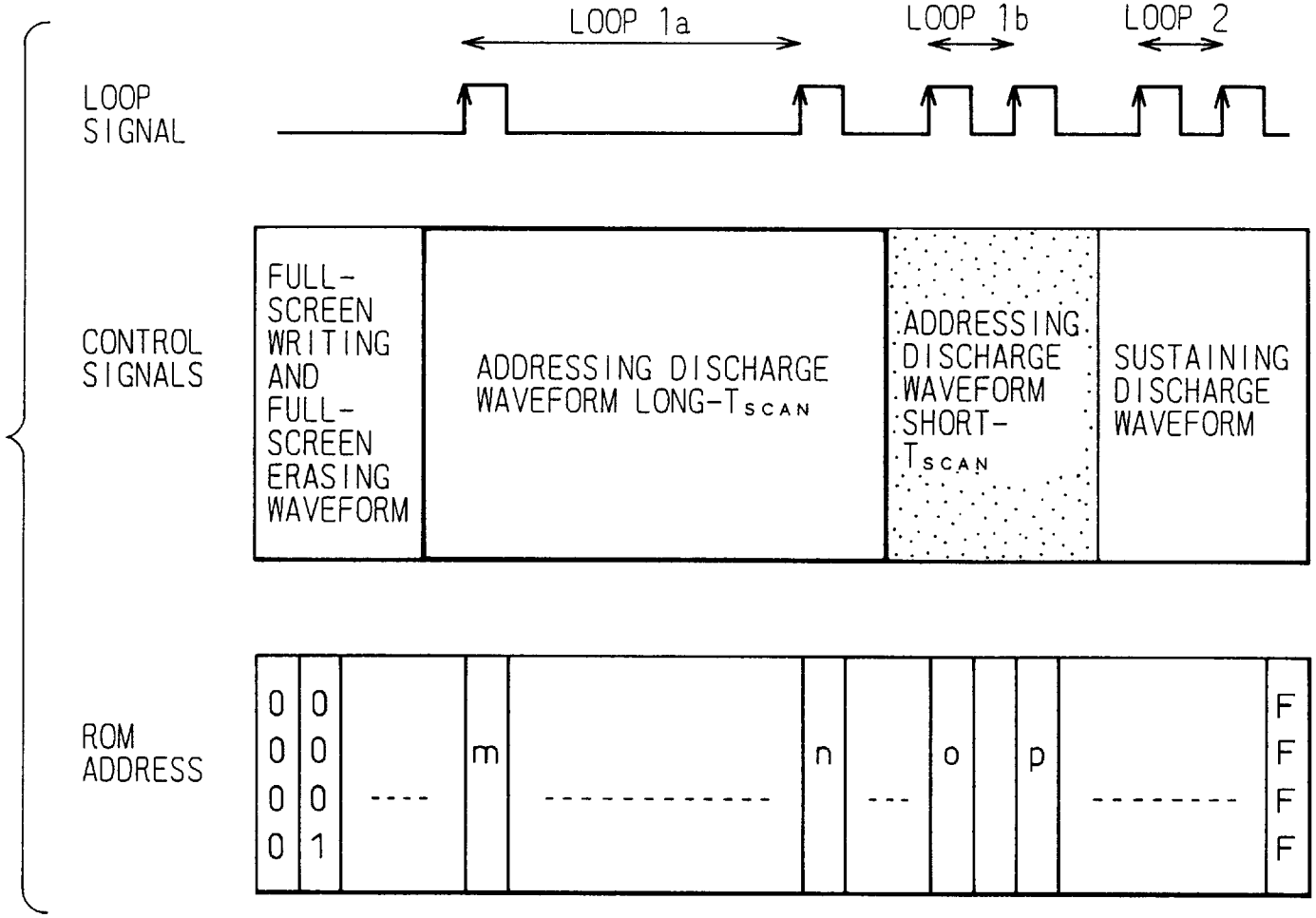
FIG. 11 is a diagram showing the relationship between the contents of a driving waveform ROM and a loop signal which are employed in the first embodiment.

In this embodiment, the pulse duration of a scanning pulse to be applied to the first and second scan lines is made longer than that of a scanning pulse to be applied to the other scan lines. This means that the scanning pulse assumes two kinds of pulse durations. The addressing discharge waveform is therefore designed to assume two kinds of patterns; patterns long-Tscan and short-Tscan. The pattern long-Tscan is regarded as loop 1*a*, and the pattern short-Tscan is regarded as loop 1*b*. Loop 1*a* is repeated twice according to the timing of scanning the first and second scan lines. Thereafter, loop 1*b* is repeated 478 times. This enables the control for extending the pulse duration of a scanning pulse relative only to the first and second scan lines. Specifically, in FIG. 11, an area from address 0 to address m−1 in the driving wave ROM 115 is read for full-screen writing and full-screen erasing, and then loop 1*a* in an area from address m to address n is read twice. Thereafter, loop 1*b* in an area from address o to address p is read repeatedly 478 times. Finally, an area from address p+1 to the last address is read.

The time required for pattern long-Tscan is determined with data to be written in the driving waveform ROM 115. The pulse duration of a scanning pulse can therefore be set freely for each unit by rewriting the data stored or replacing the driving waveform ROM 115 with another.

In the first embodiment, the scanning pulse assumes two kinds of pulse durations; pulse durations long-Tscan and short-Tscan. The number of kinds of pulse durations may be three.

Figure 12:
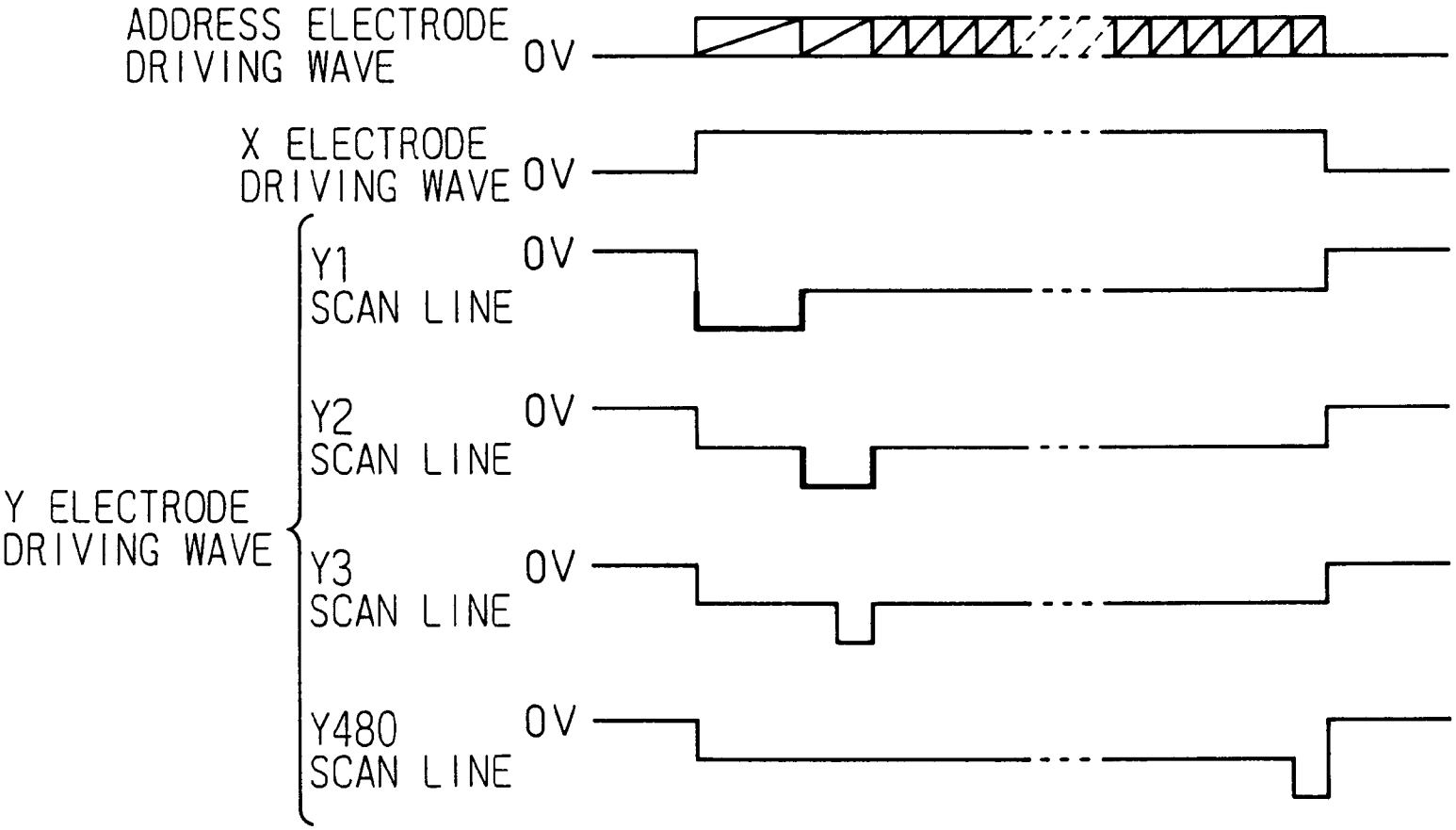
FIG. 12 is a detailed diagram of driving waves to be applied during an addressing period in the second embodiment.

FIG. 12 is a diagram showing in detail a driving waveform to be applied during an addressing discharge period in the second embodiment. In the second embodiment, the constituent features are identical to those in the first embodiment except the driving wave to be applied during an addressing discharge period.

As shown in FIG. 12, in the second embodiment, the pulse duration of a scanning pulse is different among the first scan line Y1, second scan line Y2, and third scan line and thereafter. For example, a scanning pulse having a pulse duration of 9 microseconds is applied to the first scan line, a scanning pulse having a pulse duration of 6 microseconds is applied to the second scan line, and a scanning pulse having a pulse duration of 3.5 microseconds is applied to the third scan line and thereafter. As mentioned above, since the first scan line does not undergo a priming effect at all, the first scan line has a very high probability of imperfect addressing discharge. The second scan line has a higher probability of imperfect addressing discharge than the third scan line and thereafter but the probability is not so high as that of the first scan line. When the pulse duration of a scanning pulse is set independently, finer control becomes possible. Herein, one kind of initial scanning pulse extension for differentiating the pulse duration of a scanning pulse to be extended from another pulse duration is referred to as initial scanning pulse extension 2. Another kind of initial scanning pulse extension in which the scanning pulse duration of a scanning pulse to be extended is the same as that in the first embodiment is referred to as initial scanning pulse extension 1.

Figure 13:
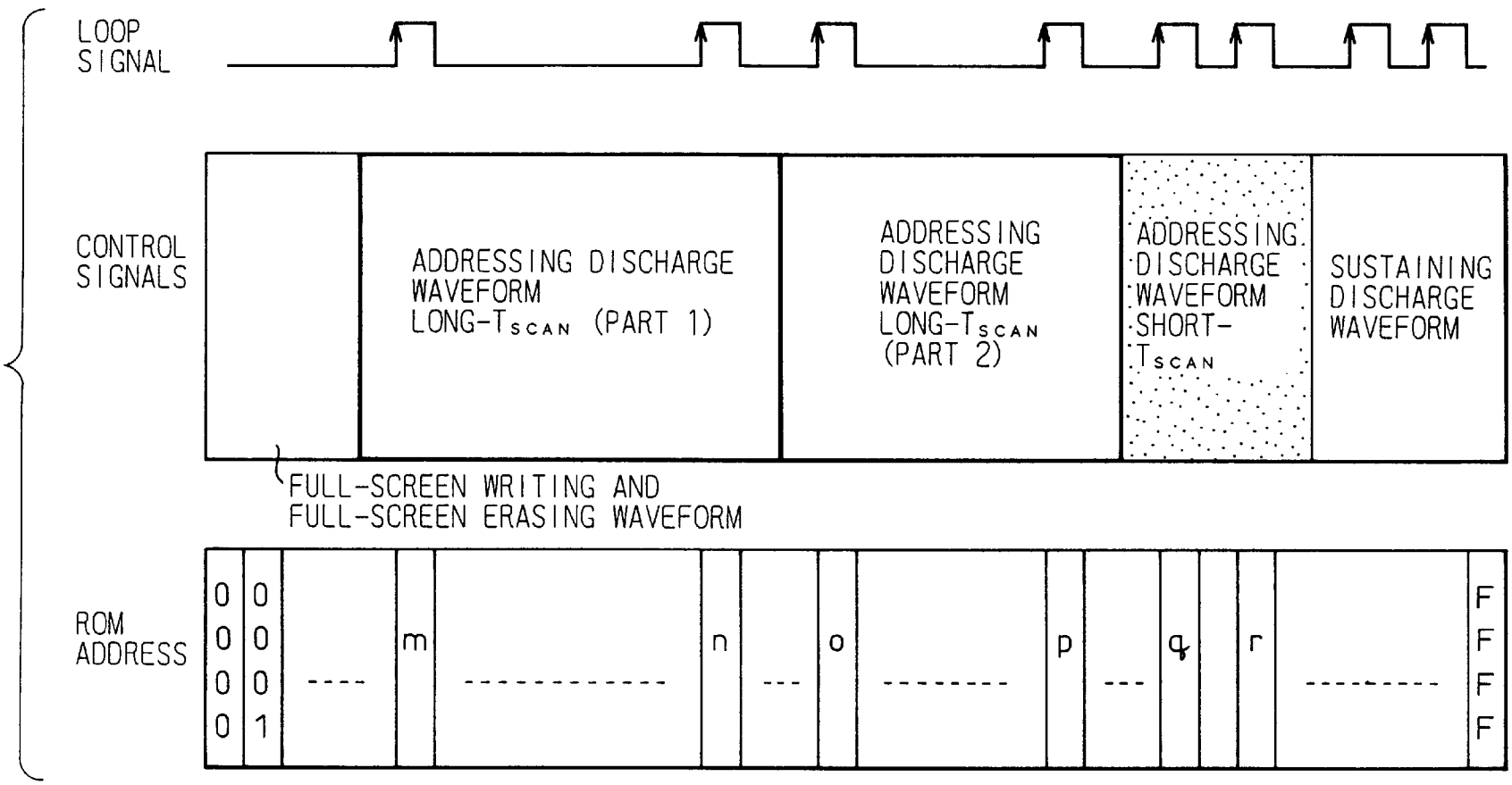
FIG. 13 is a diagram showing the relationship between the contents of a driving waveform ROM and a loop signal which are employed in the second embodiment.

FIG. 13 is a diagram showing the relationship between the contents of the driving waveform ROM 115 and a loop signal which are employed in the second embodiment.

As shown in FIG. 13, waveform long-Tscan (part 1) having a long pulse duration, waveform long-Tscan (part 2) having an intermediate pulse duration, and waveform short-Tscan having a short pulse duration are stored in correspondence to an addressing discharge period. The waveform long-Tscan (part 1) is regarded as loop 1*a*, waveform long-Tscan (part 2) is regarded as loop 1*b*, and waveform short-Tscan is regarded as loop 1*c*. For the first scan line, the loop 1*a* is read. For the second scan line, the loop 1*b* is read. For the third scan line and thereafter, the loop 1*c* is read repeatedly 478 times. Specifically, in FIG. 13, after an area from address 0 to address m−1 in the driving wave ROM 115 is read for full-screen writing and full-screen erasing, loop 1*a* in an area from address m to address n is read once, and loop 1*b* in an area from address o to address p is read once. Loop 1*c* in an area from address q to address r is then read repeatedly 478 times. Finally, an area from address r+1 to the last address is read.

Figure 14:
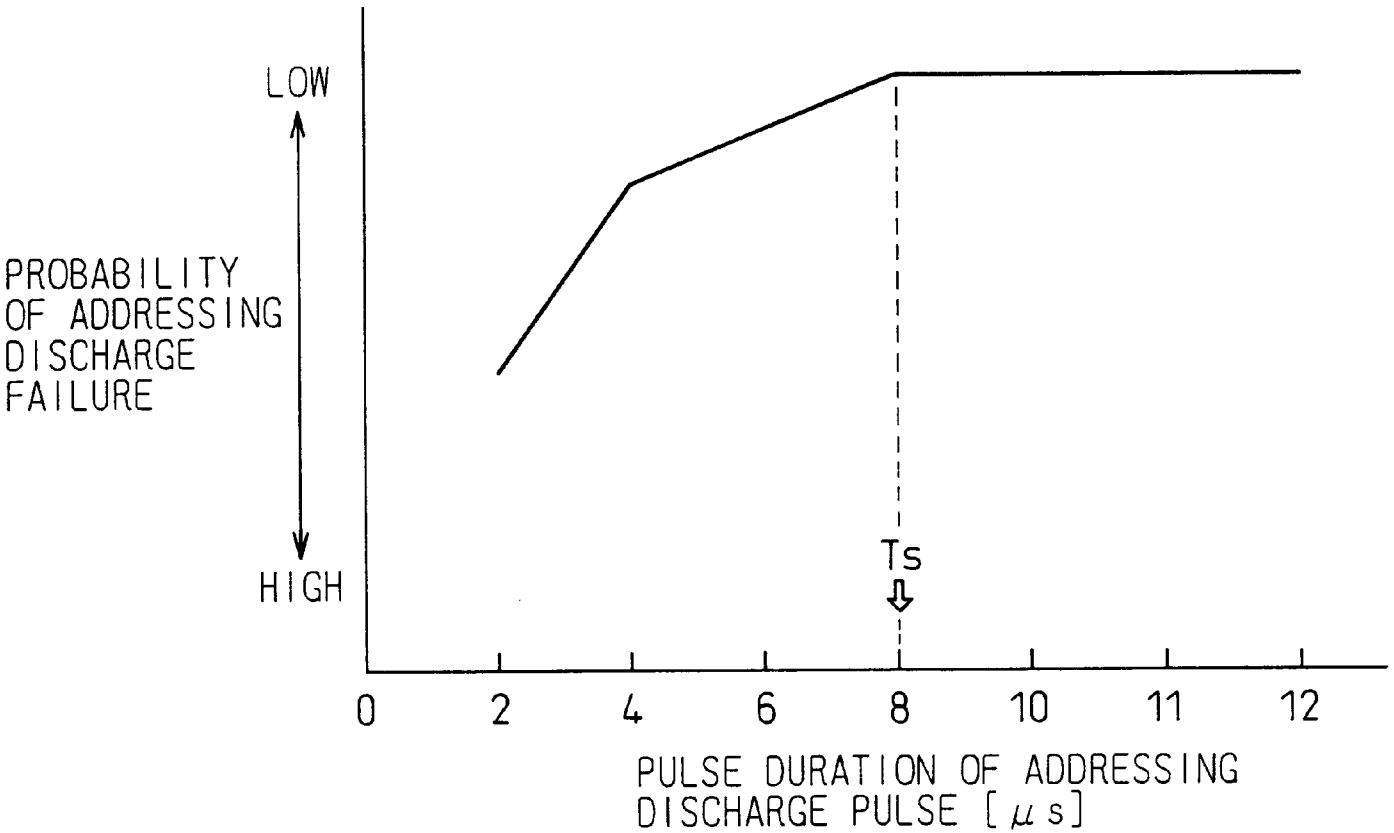
FIG. 14 is a diagram showing the relationship between the pulse duration of an addressing discharge pulse and the probability of an addressing discharge failure.

Next, a method of determining the pulse duration of a scanning pulse to be applied to the first and second scan lines will be described. FIG. 14 shows an example of the relationship between the pulse duration of a scanning pulse and the probability of an address discharge failure. According to this example, when the pulse duration of a scanning pulse becomes equal to or shorter than 4 microseconds, the probability of a failure increases rapidly. When the pulse duration is equal to or longer than 8 microseconds (Ts), the probability of a failure remains constant. It is therefore desired that the pulse duration of a scanning pulse to be applied to the first and second scan lines should be equal to or longer than 4 microseconds, or more preferably, equal to or longer than 8 microseconds. It is also desired that the pulse duration of a scanning pulse to be applied to the third scan line and thereafter is set to 4 microseconds or longer. As mentioned above, a time allotted to addressing discharge is determined in terms of the relationship with a display speed, a display luminance, or the like. It is hard to extend the pulse duration very much.

In the first and second embodiments, the pulse duration of a scanning pulse to be applied to the first and second scan lines is made longer than that of a scanning pulse to be applied to the third scan line and thereafter. Alternatively, the pulse duration of a scanning pulse to be applied to the first to third or fourth scan lines may be made longer. In either case, in the first and second embodiments, the pulse duration of a scanning pulse, to be applied to the first several scan lines which have a low probability of immediately previous addressing discharge and which are scanned initially, is made longer. In practice, a scan line to which numerous cells each having a high probability of an addressing discharge failure are connected is created according to a display pattern. The third embodiment and thereafter attempt to minimize the occurrence of an addressing discharge failure in the middle of a screen.

Prior to a description of the third embodiment, the kind of cell that is prone to an addressing discharge failure will be described. An addressing discharge failure is likely to occur in a cell in which the two states listed in Table 2 are established.

TABLE 2

| States leading to a high probability of an addressing discharge failure | |
|---|---|
| Name | State |
| State 1 | A cell above an arbitrary cell is unlit. |
| State 2 | An arbitrary cell is unlit during an immediately previous subframe. |

To begin with, state 1 will be described with reference to FIG. 15A.

Figure 15A:
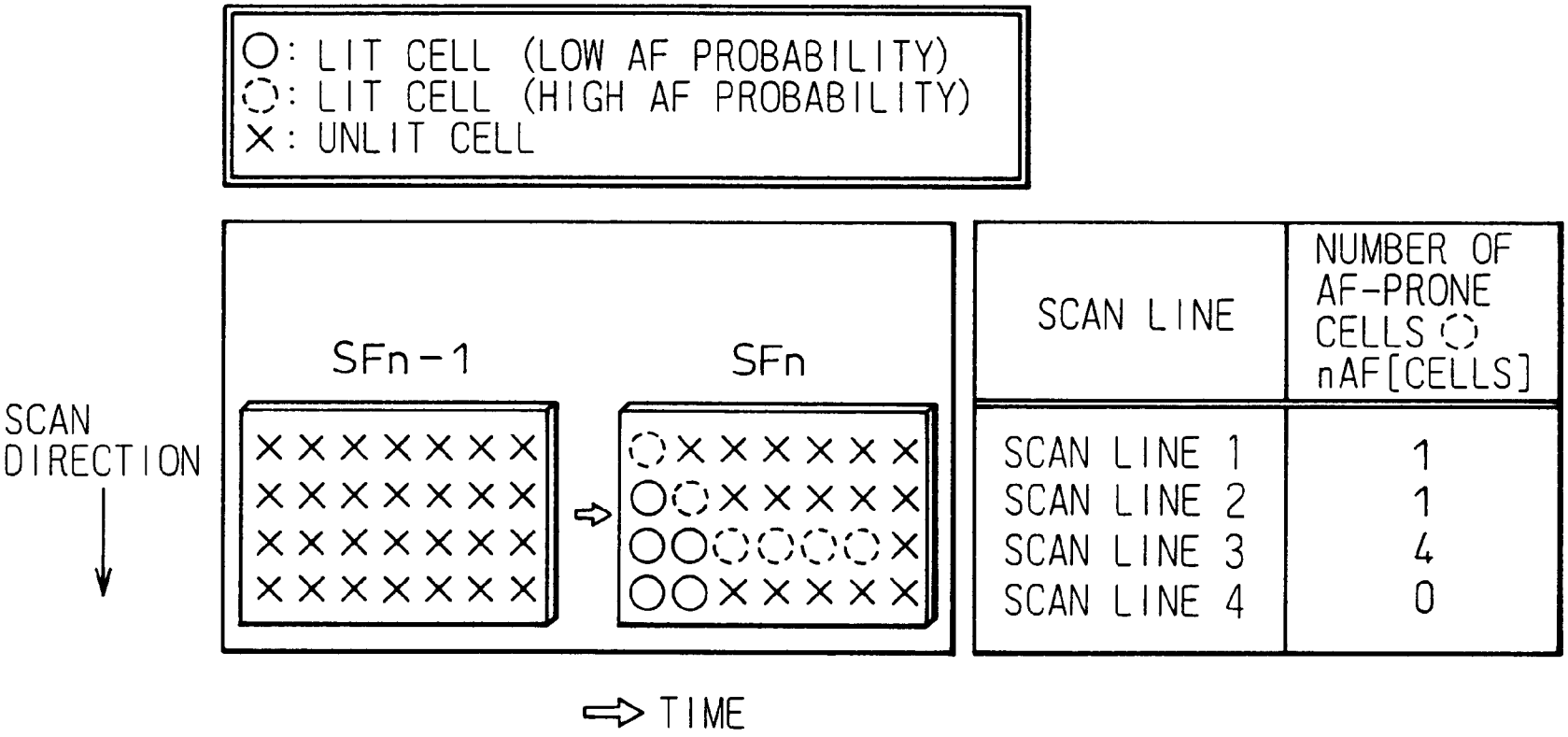
FIGS. 15A and 15B are explanatory diagrams concerning the probability of an addressing discharge failure occurring in a screen.

In FIG. 15A, a circle denotes a lit cell, and a cross denotes an unlit cell. A circle is drawn with a solid line or dotted line. A circle drawn with a solid line denotes a cell having a low probability of an addressing discharge failure. A circle drawn with a dotted line denotes a cell having a high probability of an addressing discharge failure. SFn−1 denotes a subframe immediately previous to subframe SFn. Assume that all cells are unlit during subframe SFn-1, and display is achieved according to a pattern defined with circles in the drawing during the next subframe SFn. At this time, when a cell above a lit cell is unlit, the lit cell is drawn with a dotted line; that is, the lit cell has a high probability of an addressing discharge failure. In this manner, the probability of an addressing discharge failure of an arbitrary lit cell can be predicted by checking the lit or unlit state of a cell above the cell. In this example, the number of cells having a high probability of an addressing discharge failure and being connected to the third scan line is as large as four. It is apparent that the pulse duration of a scanning pulse that should be extended is that of a scanning pulse to be applied to the third scan line.

Figure 15B:
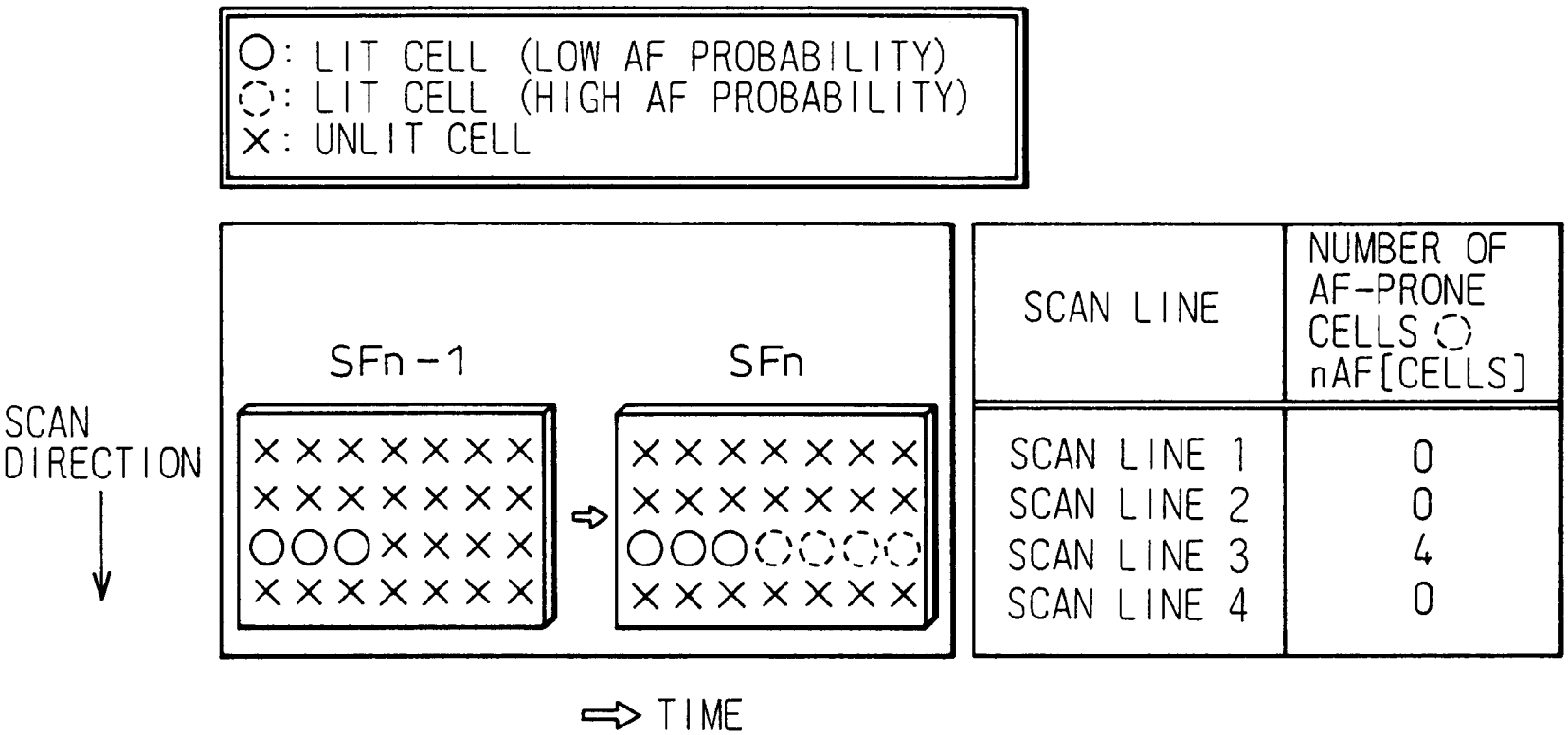

Another state 2 will be described with reference to FIG. 15B.

It is seen that all the cells connected to the third scan line are lit during subframe SFn, and only three of the cells connected to the third scan line are lit during subframe SFn−1. The cells that are unlit during the immediately previous subframe has a high probability of an addressing discharge failure. In this example, the number of cells having a high probability of an addressing discharge failure and being connected to the third scan line is the largest or four. It can therefore be said that the pulse duration of a scanning pulse that should be first extended is that of a scanning pulse to be applied to the third scan line.

In this embodiment, a cell meeting the aforesaid two states is predicted as a cell having a high probability of an addressing discharge failure (that is, as an AF-prone cell meaning a cell prone to an addressing discharge failure). Scan lines for which the pulse duration of a scanning pulse is extended are selected from among scan lines to each of which a large number of AF-prone cells are connected. Thus, a total number of cells prone to imperfect addressing discharge is calculated for each scan line. Scan lines for which it is thought effective to extend the pulse duration of a scanning pulse are selected, and the pulse duration is extended. A method thus making it possible to realize effective reduction of occurrence of imperfect addressing discharge in accordance with a display pattern is referred to as arbitrary scanning pulse duration extension.

Figure 16:
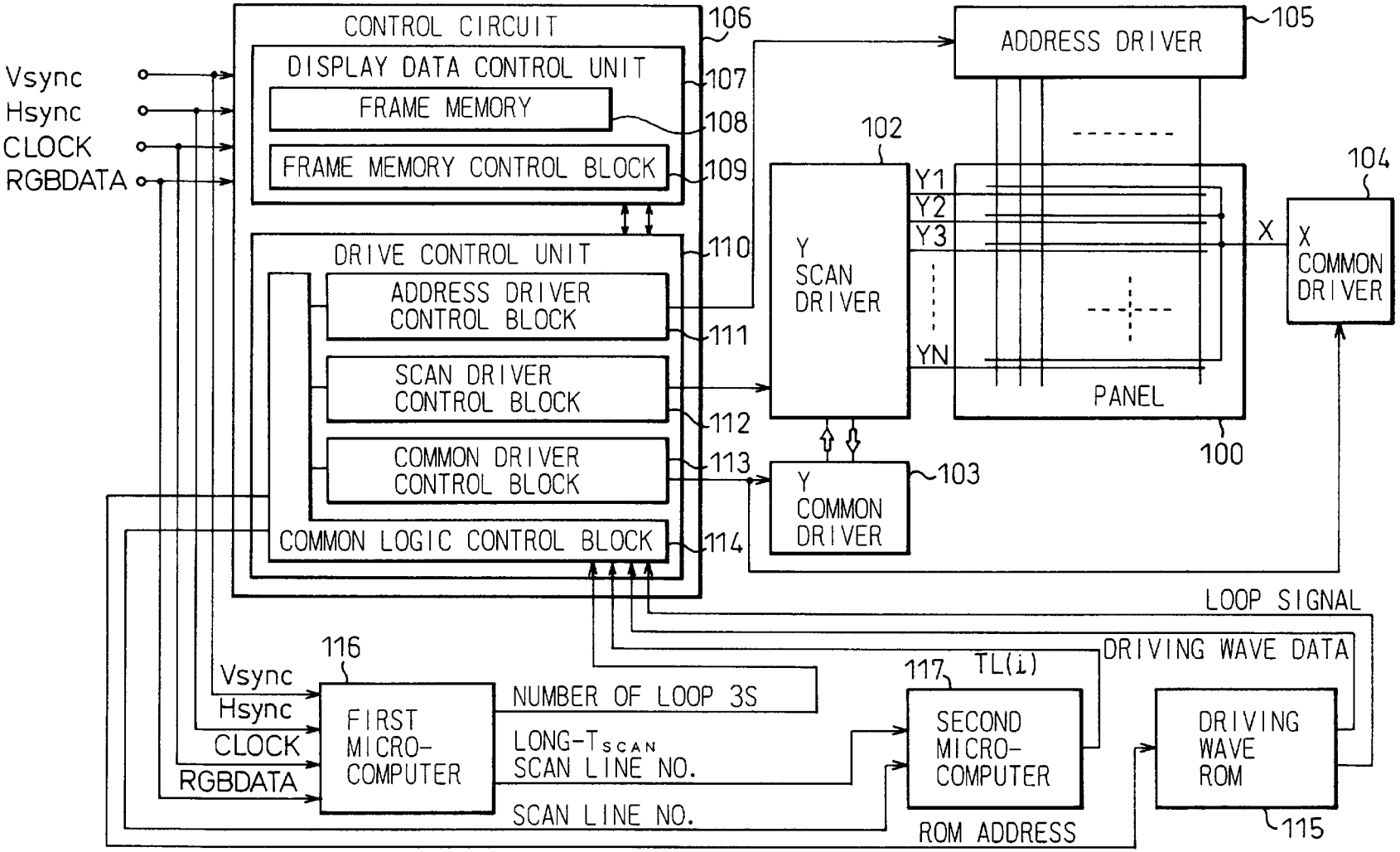
FIG. 16 is a diagram showing the overall configuration of a PDP of the third embodiment.

FIG. 16 is a diagram showing the overall configuration of a PDP display of the third embodiment. As apparent from the drawing, the difference is that first and second microcomputers 116 and 117 are added. The first microcomputer 116 judges if a cell concerned is an AF-prone cell that will be described later and selects scan lines, for which the pulse duration of a scanning pulse should be made longer, from among scan lines to each of which a large number of AF-prone cells are connected. Depending on a method of judgment, if necessary, extended pulse durations are calculated and output. The second microcomputer 117 judges if a scan line concerned is a scan line that is determined as a scan line, for which the pulse duration of a scanning pulse should be extended, by the first microcomputer 116. In this embodiment, the first and second microcomputers 116 and 117 are newly included. Alternatively, only one microcomputer may be used to carry out all control operations including the operations of the common logic control block 114.

Figure 17:
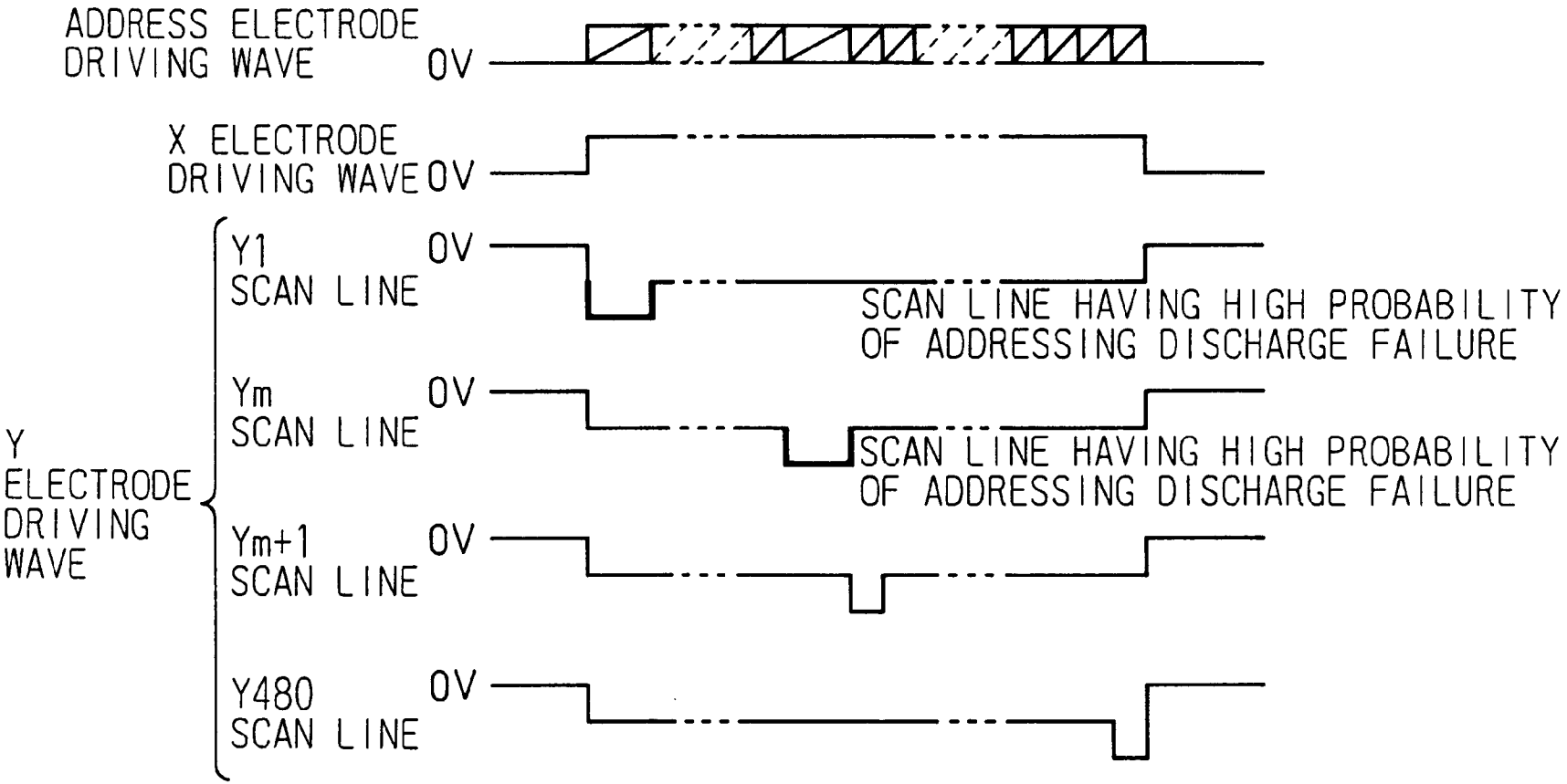
FIG. 17 is a detailed diagram of driving waveforms to be applied during an addressing period in the third embodiment.

FIG. 17 is a diagram showing in detail driving waveforms to be applied during an addressing discharge period in the third embodiment. As shown in FIG. 17, a scanning pulse having a long pulse duration is applied to any scan line which a large number of AF-prone cells are connected.

Figure 18:
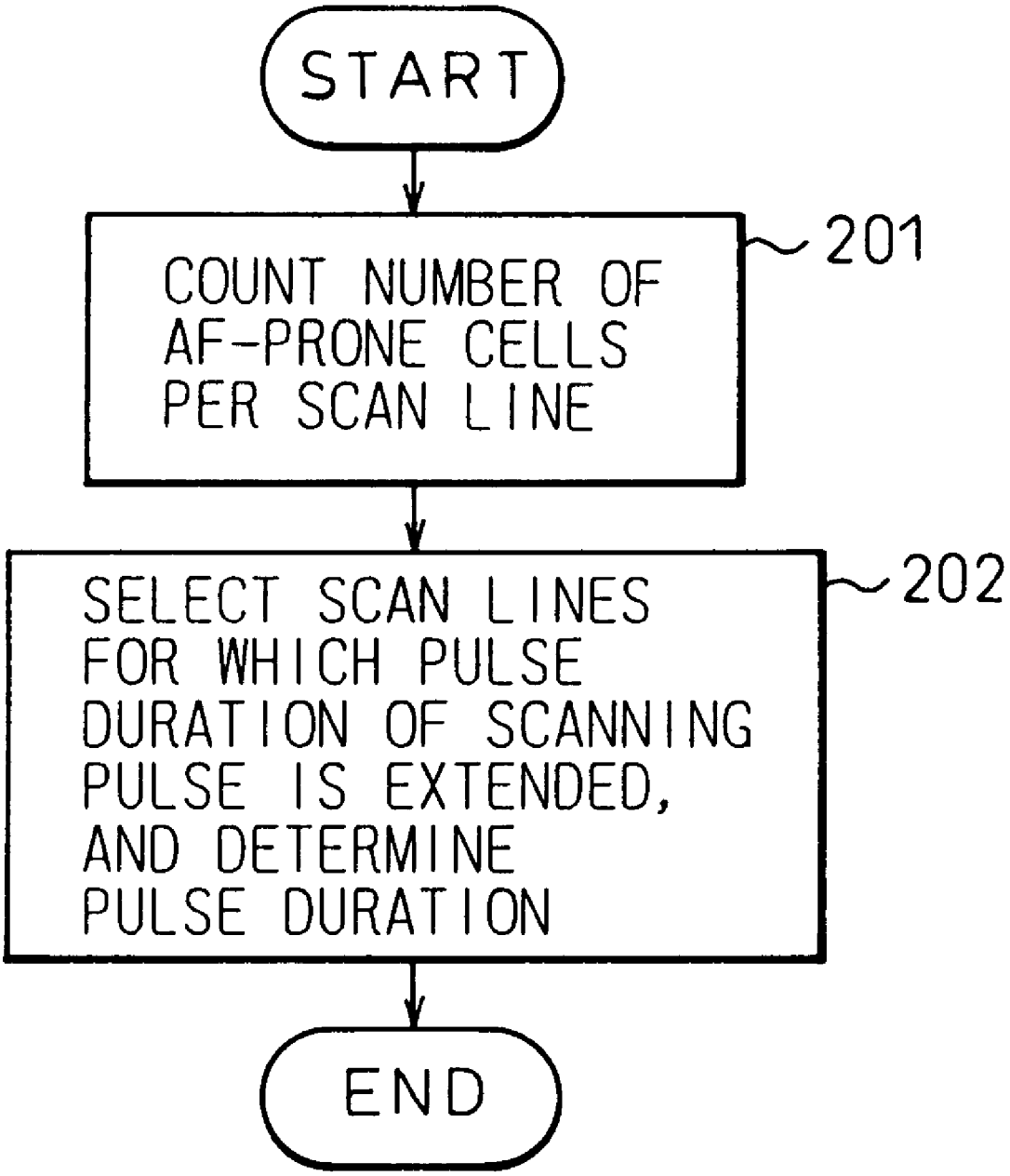
FIG. 18 is a flowchart describing processing to be performed for extending the pulse duration of a scanning pulse in the third embodiment.

FIG. 18 is a flowchart describing processing to be executed by the first microcomputer 116. As mentioned above, the PDP display achieves gray-scale representation by utilizing subframes. A display data signal (RGBDATA) to be supplied externally cannot be applied to the PDP 100 as it is. The display data control unit 107 therefore includes the frame memory 108 in which display data (RGBDATA) supplied externally is temporarily stored and from which the display data is read in a form suitable for the PDP 100.

At step 201, display data RGBDATA supplied externally and stored temporarily in the frame memory 108 is used to calculate the number of AF-prone cells per scan line. At step 202, based on the number of AF-prone cells per scan line which is calculated at step 201, scan lines for which the pulse duration of a scanning pulse is extended are selected and an extended pulse duration is determined.

Figure 19:
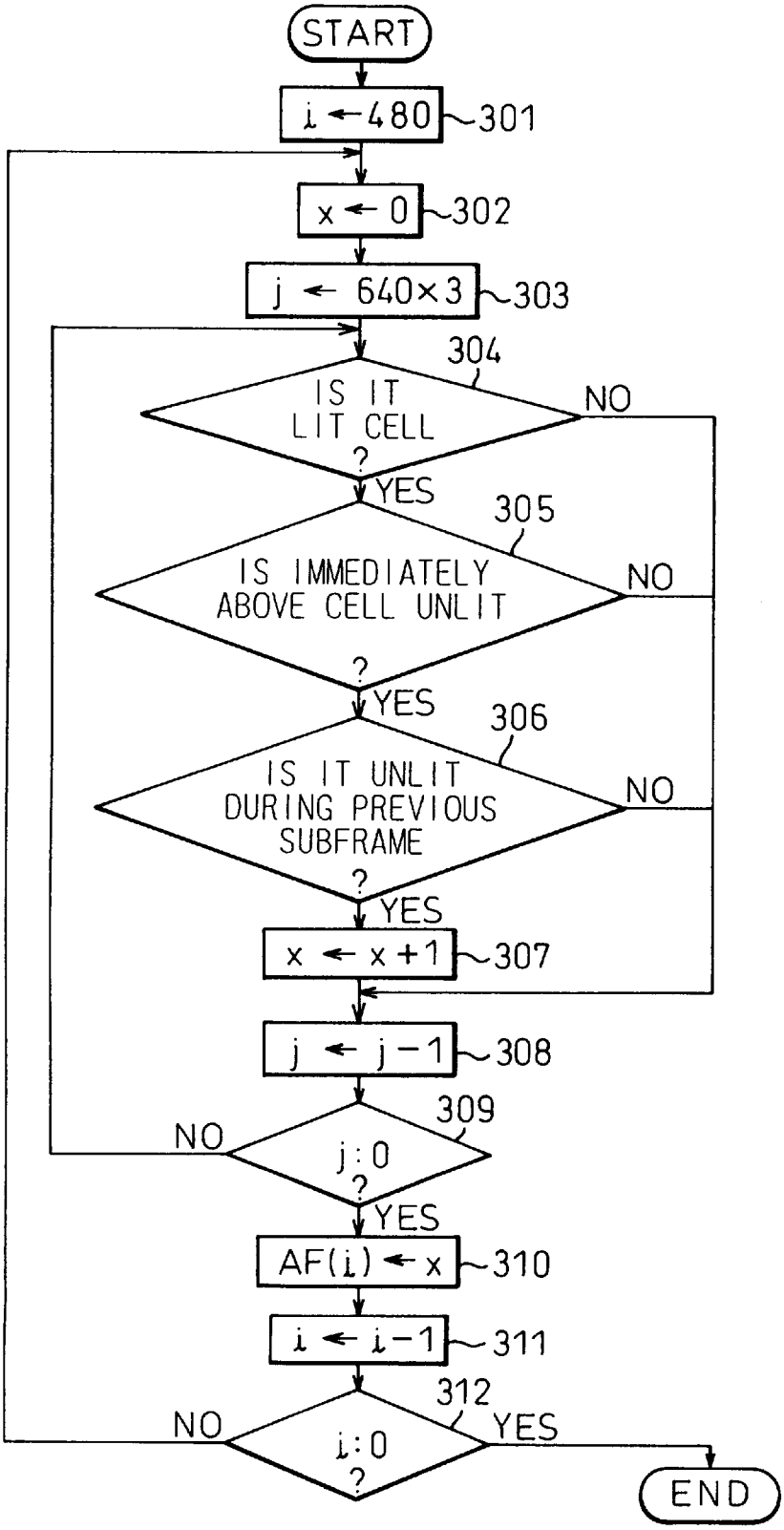
FIG. 19 is a flowchart describing counting of the number of addressing discharge failures per scan line in the third embodiment.

FIG. 19 is a flowchart describing in detail the processing for calculating the number of AF-prone cells per scan line which is executed at step 201 in the flowchart of FIG. 10.

In this processing, it is judged if each cell meets the two states listed in Table 2 for each of 480 scan lines; that is, if each cell is an AF-prone cell, and thus the number of cells meeting the two states is calculated. The number of AF-prone cells connected to the i-th scan line is stored as an AF(i) value. At step 301, 480 is specified in a register i so that the above processing can be executed for all the 480 scan lines. At step 302, a register x holding the number of AF-prone cells is cleared. At step 303, 1920 is specified in a register j so that it can be judged if each of 640 cells connected to respective scan lines is an AF-prone cell relative to R, G, and B color data. At step 304, it is judged if each cell is a lit cell. At step 305, it is judged if a cell that is scanned immediately previously to each cell or a cell immediately above each cell is lit. At step 307, it is judged if each cell was lit during the previous subframe. Since a cell meeting these conditions is an AF-prone cell, the value in a register x is incremented by one at step 307. In any other case, nothing is performed. At step 308, the value in the register j is decremented by one. At step 309, it is judged if the value in the register j is zero. The processing from step 304 to 308 is repeated until the value in the register j becomes zero. Finally, the value in the register x indicates the number of AF-prone cells per scan line. At step 310, the value in the register x is stored as an AF(i) value. At step 311, the value in the register i is decremented by one. At step 312, it is judged if the value in the register j is zero. The processing from step 302 to 311 is repeated until the value in the register i becomes zero. Finally, the number of AF-prone cells or an AF(i) value is calculated relative to all the scan lines.

Next, selecting scan lines for which the pulse duration of a scanning pulse is extended and determining the pulse duration, which are executed at step 202 in FIG. 18, will be described. Since a "total permissible addressing time" usable for extending addressing discharge is fixed, a pulse duration of a scanning pulse to be extended and the number of scan lines to which the extended pulse duration applies are limited in the arbitrary scanning pulse duration extension. As a method of determining the extended pulse duration, various methods are conceivable. Three kinds of methods listed in Table 3 will be described below.

TABLE 3

| | Various kinds of arbitrary scanning pulse duration extension methods | | |
|---|---|---|---|
| | Specifications | | |
| Name | Pulse duration of a scanning pulse | Number of extended scanning pulses | Features |
| Arbitrary scanning pulse duration extension 1 | Fixed | Fixed (fixed number of pulses) | Easy control |
| Arbitrary scanning pulse duration extension 2 | Variable | Fixed (fixed maximum number of pulses) | The permissib1e addressing time can be used more effectively than in method 1. |
| Arbitrary scanning pulse duration extension 3 | Variable | Variable | The pulse duration can be extended relative to a larger number of scan lines. However, a too large number of scanning pulses reduces an effect. |

The three methods are mutually different in terms of pulse duration of a scanning pulse or whether the number of extended scanning pulses is fixed in advance or variable. Three kinds of processing based on the methods will be described below.

Arbitrary Scanning Pulse Duration Extension 1

As listed in Table 3, according to this method, an extended pulse duration of a scanning pulse is fixed to pulse duration long-Tscan. The number of scan lines for which a scanning pulse is extended is fixed, too. For selecting scan lines for which the pulse duration of a scanning pulse is extended, a given number n of scan lines are selected in descending order of number of AF-prone cells.

Figure 20:
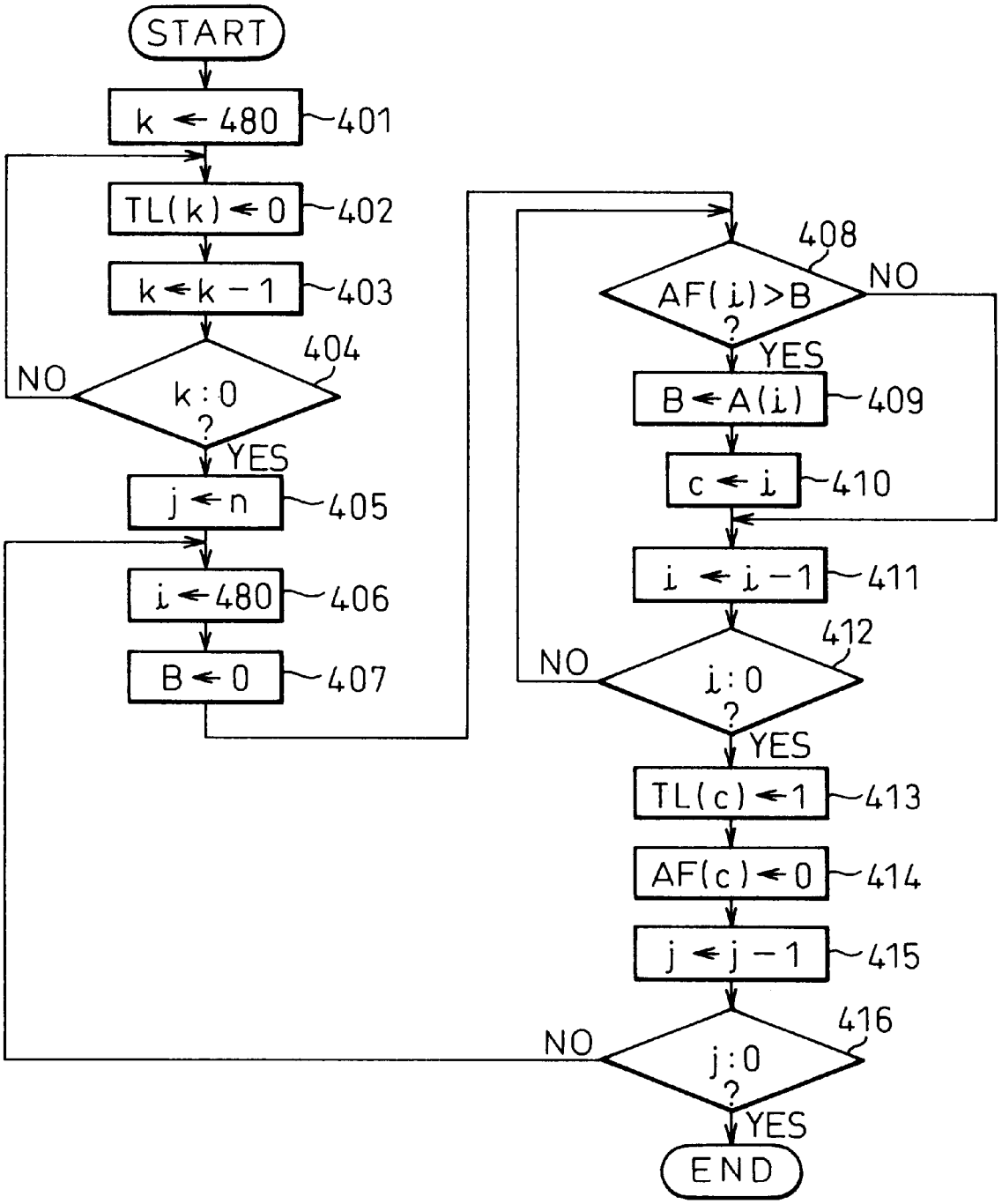
FIG. 20 is a flowchart describing a first determination for determining scan lines for which the pulse duration of a scanning pulse is extended, which is employed in the third embodiment.

Processing based on this method, which is executed at step 202 in the flowchart of FIG. 18 and which is concerned with selection of scan lines for which the pulse duration of a scanning pulse is extended and with determination of the pulse duration, is described in the flowchart of FIG. 20.

Whether or not a scanning pulse to be applied to the k-th scan line is extended is indicated with a TL(k) value. When the TL(k) value is a 1, a pulse duration is extended. When the TL(k) value is a 0, the pulse duration remains short.

Step 401 to 404 perform to initialization for setting the TL(k) values to 0s.

At step 405, the number n of scan lines for which the pulse duration of a scanning pulse is extended is set in the register j. At step 406, 480 is set in the register i. At step 409, 0 is set in a register B. Step 408 to 412 belong to a routine for searching for a scan line associated with the largest AF(i) value. A scan line c associated with the largest AF(i) value is then determined. At step 413, 1 is set as a TL(c) value. At step 414, 0 is set as an AF(c) value. The scan line determined to be associated with the largest AF(i) value is thus excluded by the routine for searching for a scan line associated with the largest AF(i) value of step 408 to 412. At step 415, the value in the register j is decremented by one. At step 416, it is judged if the register j holds a 0. The processing from step 406 to 415 is repeated until the value in the register j becomes zero. Consequently, n scan lines are selected in descending order of number of AF-prone cells. When the i-th scan line is selected, the TL(i) value is set to 1.

Arbitrary Scanning Pulse Duration Extension 2

As listed in Table 3, this method specifies a maximum number n of scan lines for which a scanning pulse is extended. When the number of scan lines associated with the numbers of AF-prone cells which are larger than a given value Amin is larger than the maximum number n of scan lines, a given number n of scan lines are selected in descending order of number of AF-prone cells in the same manner as the arbitrary scanning pulse duration extension 1. When the number of scan lines associated with the numbers of AF-prone cells which are larger than the given value Amin is smaller than the maximum number n of scan lines, all the scan lines are regarded as scan lines for which a scanning pulse is extended. Depending on the number of scan lines, an extended pulse duration long-Tscan is maximized.

Figure 21:
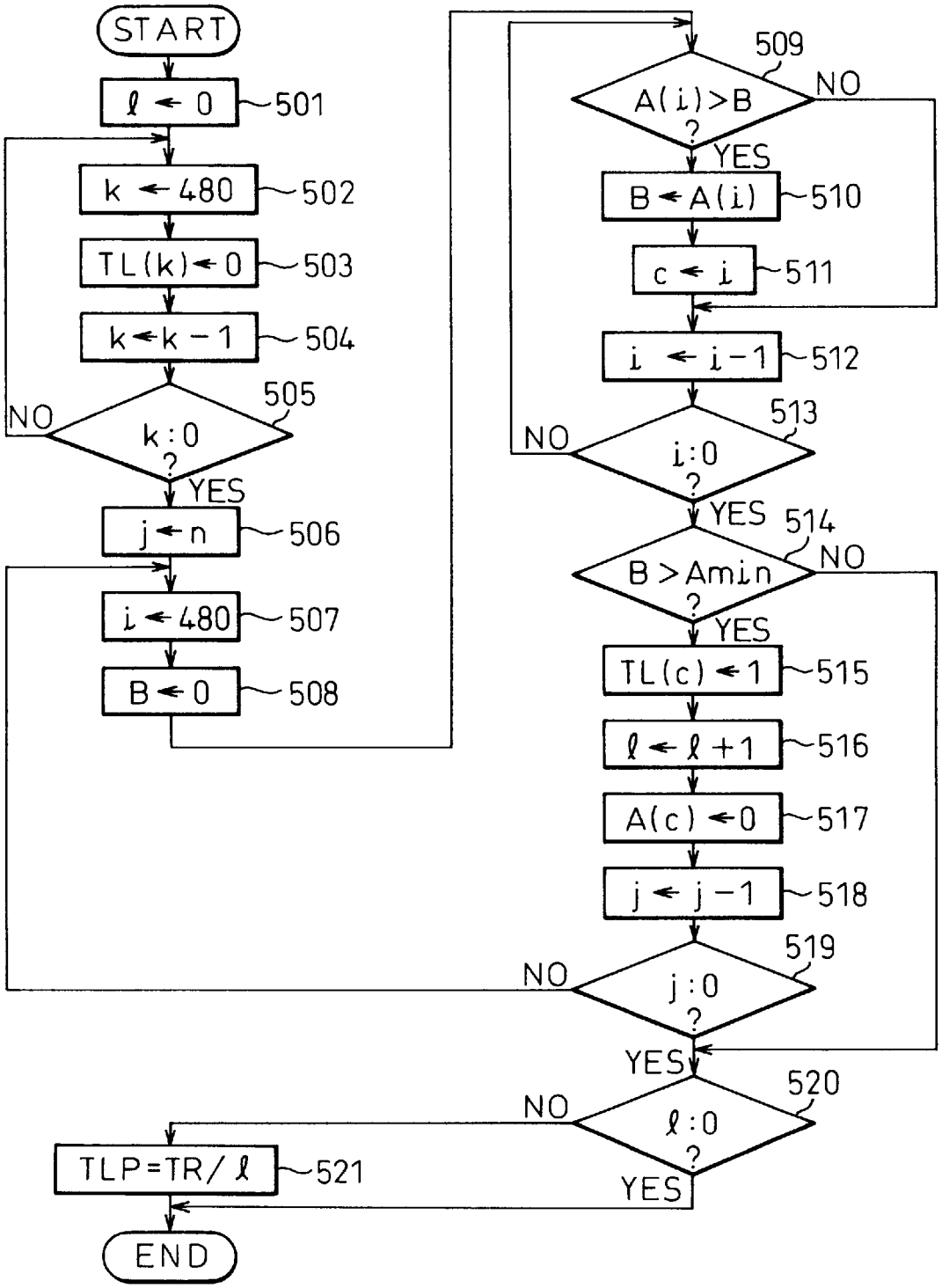
FIG. 21 is a flowchart describing a second determination for determining scan lines for which the pulse duration of a scanning pulse is extended, which is employed in the third embodiment.

Processing based on this method, which is executed at step 202 in the flowchart of FIG. 18 and which is concerned with selection of scan lines for which the pulse duration of a scanning pulse is extended and with determination of the pulse duration, is described by the flowchart of FIG. 21.

As apparent from comparison with FIG. 20, the flowchart of FIG. 21 is analogous to the flowchart of FIG. 21. A difference lies at steps 501, 514, 516, 520, and 521. At step 501, 0 is set in a register 1. Similarly to FIG. 21, at step 513, a scan line associated with the largest AF(i) value is calculated. The AF(i) value is compared with the Amin value at step 514. If the AF(i) value is larger than the Amin value, the same processing as that described in FIG. 20 is carried out. In addition, the value in the register 1 is incremented by one at step 516. The loop is repeated n times. If the number of AF-prone cells which is associated with a scan line supposed to be associated with the n-th largest number of AF-prone cells is larger than the Amin value, n is held in the register 1. The resultant processing is the same as that described in FIG. 20. If it is judged at step 514 that the AF(i) value is smaller than the Amin value, the numbers of AF-prone cells associated with the remaining scan lines are smaller than the Amin value. Control is then passed to step 520. It is then judged if the value in the register 1 is a 0. This is intended to prevent occurrence of an error caused by division, because when there is no scan line associated with the number of AF-prone cells which is equal to or larger than the Amin value, the value in the register 1 is a 0. At step 521, the permissible addressing discharge time is divided by the value in the register 1. An increased pulse duration that defines a longer scanning pulse than a normal short scanning pulse is thus calculated.

Arbitrary Scanning Pulse Duration Extension 3

As listed in Table 3, this method selects a scan line associated with the number of AF-prone cells which is larger than the given value Amin is selected as a scan line for which the pulse duration of a scanning pulse is made longer. An extended pulse duration long-Tscan is determined according to the number of such scan lines.

Figure 22:
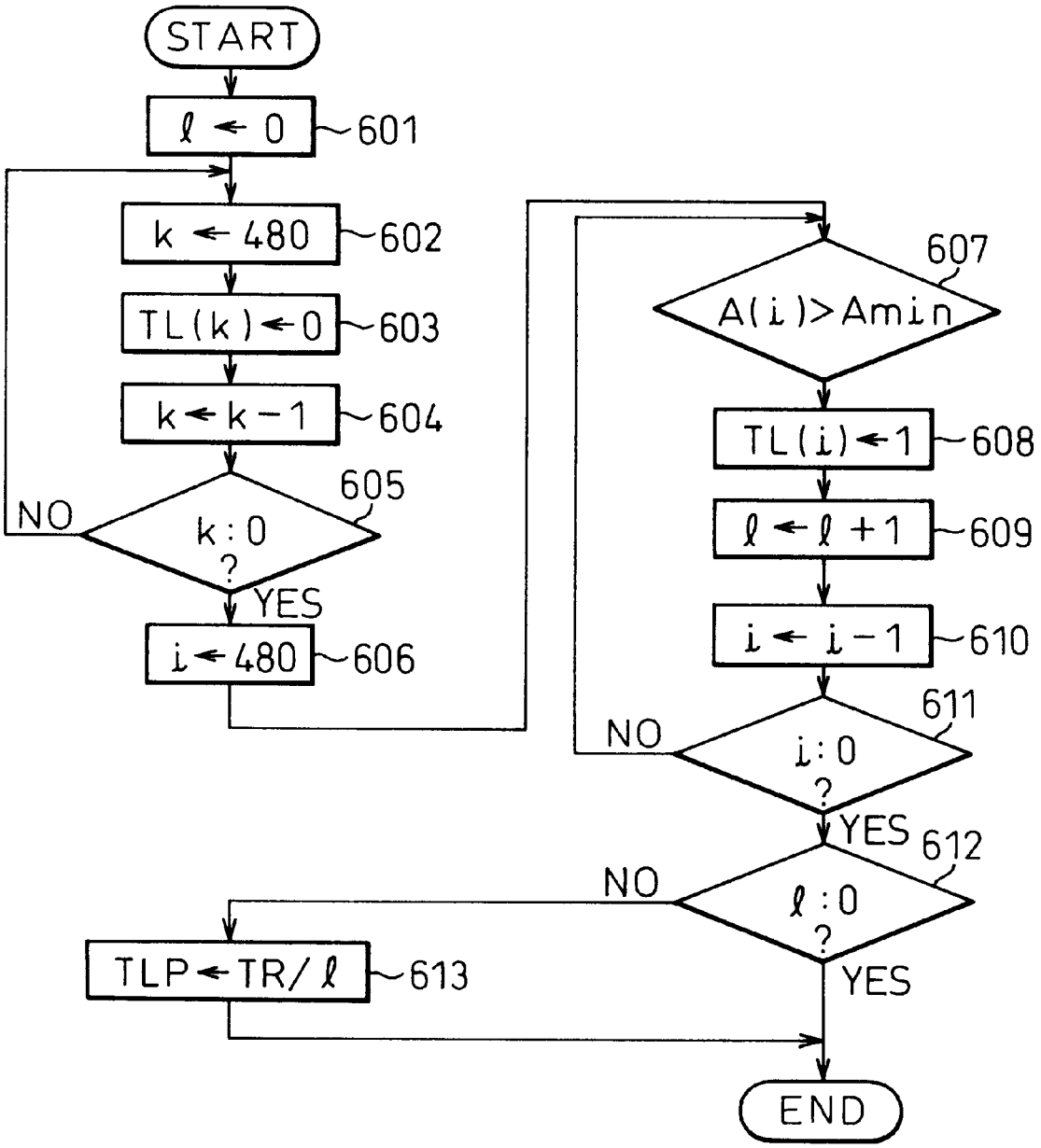
FIG. 22 is a flowchart describing a third determination for determining display lines for which the pulse duration of a scanning pulse is extended, which is employed in the third embodiment.

Processing based on this method, which is executed at step 202 in the flowchart of FIG. 18 and which is concerned with selection of scan lines for which the pulse duration of a scanning pulse is extended and determination of the pulse duration, is described by the flowchart of FIG. 22.

As apparent from comparison with FIG. 21, the flowchart of FIG. 22 has the step of calculating a scan line associated with a maximum number of AF-prone cells excluded from the flowchart of FIG. 21. At step 607 to 611, scan lines associated with the numbers of AF-prone cells which are larger than the Amin value are calculated, and 1 is set as the TL(i) values associated with all the scan lines. At steps 612 and 613, it is judged if the register 1 holds a 0, and the permissible addressing discharge time is divided by the value in the register 1. Thus, an increased pulse duration that defines a longer scanning pulse than a normal short scanning pulse is calculated.

The operations to be performed for addressing discharge on the basis of scan lines for which a scanning pulse is extended and of an extended pulse duration long-Tscan, which are determined according to any of the three kinds of arbitrary scanning pulse duration extension methods, will be described below.

In the arbitrary scanning pulse duration extension 1, a scanning pulse assumes two kinds of pulse durations; pulse durations long-Tscan and short-Tscan. Similarly to the first embodiment, an addressing discharge waveform assumes two kinds of patterns; loops 1*a* and 1*b*. Loop 1*a* should be selected for a scan line to which a scanning pulse having pulse duration long-Tscan is applied. This selection is executed by the second microcomputer 117. Specifically, when an addressing period starts, a scan line number is recognized. It is judged if the scan line number agrees with a scan line that is determined by the first microcomputer as a scan line to which a long-Tscan scanning pulse is applied (that is, if the scan line number agrees with the TL(i) data). If the scan line number agrees with the scan line, a TL(i) signal is output. In response to the signal, the common logic control block 114 outputs an address signal used to select loop 1*a* to the driving waveform ROM 115. A long scanning pulse corresponding to loop 1*a* is then applied. If the scan line number disagrees with the scan line, the second microcomputer 117 does not output the TL(i) signal. The common logic control block 114 outputs an address signal used to select loop 1*b* to the driving waveform ROM 115.

However, in the arbitrary scanning pulse duration extension methods 2 and 3, the long pulse duration of a scanning pulse is not always set to a given length. In the second embodiment, two kinds of long pulse durations are stored. Alternatively, the number of kinds of long pulse durations may be increased so that a loop having a pulse duration most close to a long pulse duration determined by the first microcomputer 116 can be selected. Nevertheless, herein, an example of a simpler system design that can cope with a variable pulse duration of a scanning pulse is discussed.

Figure 23:
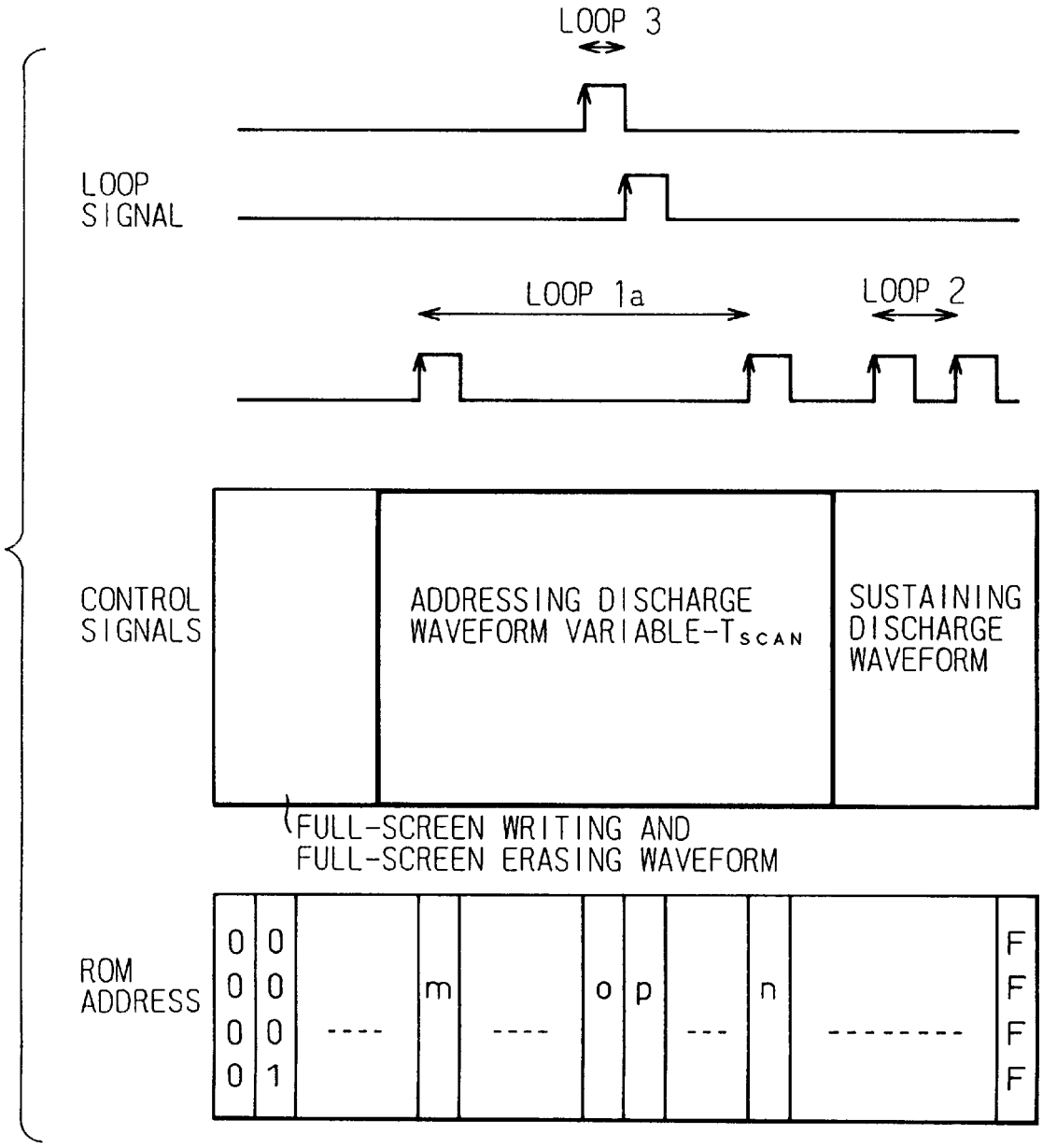
FIG. 23 is a diagram showing the relationship between the contents of a driving waveform ROM and a loop signal which are employed in the third embodiment.

FIG. 23 is a diagram showing the relationship between the contents of the driving waveform ROM and a loop signal which are employed in the third embodiment.

As illustrated, loop 1*a* having a normal short pulse duration is stored as an addressing discharge waveform variable-Tscan. For extending a scanning pulse, the on-state period of the scanning pulse should merely be extended. Loop 3 is therefore created so that part of loop 1*a* can be repeated in order to extend a scanning pulse. For a normal short scanning pulse, loop 3 is read once. For an extended scanning pulse, loop 3 is repeated in order to extend the pulse duration. The pulse duration of a scanning pulse is determined by a repetition frequency of loop 3.

Actual operations will be described. An area from address 0 to m−1 in the driving wave ROM 115 is read for full-screen writing and full-screen erasing. Thereafter, when an addressing period starts, loop 1*a* is repeated 480 times. Before each loop is started, the second microcomputer 117 recognizes a scan line number, and judges if the scan line number agrees with a scan line (that is, the TL(i) data) that is determined by the first microcomputer 116 as a scan line to which a scanning pulse having a pulse duration long-Tscan is applied. If the scan line number disagrees with the scan line, the second microcomputer 117 does not output a TL(i) signal. The common logic control block 114 outputs an address signal indicating that loop 1*a* residing in an area from address m to n in the driving wave ROM 115 is read once as it is. That is to say, loop 3 residing in an area from address o to p is read once. If the scan line number agrees with the scan line, the second microcomputer 117 outputs a TL(i) signal. The common logic control block 114 reads loop 1*a* from the area from address m to n in the driving wave ROM 115. Loop 3 in the area from address o to p is read repeatedly by the number of times specified by the first microcomputer 116. After the addressing period comes to an end, an area from address n+1 to the last address is read for sustaining discharge. Owing to the foregoing system design, a normal pulse duration of a scanning pulse can be extended to an arbitrary pulse duration.

As described previously, according to the present invention, occurrence of imperfect addressing discharge can be minimized, and display quality can be improved. In particular, when the initial scanning pulse extension is employed, occurrence of imperfect addressing discharge on the first or second scan line that has a higher possibility of imperfect addressing discharge than any other scan line can be minimized. This system design can be realized by modifying the contents of a driving wave ROM and slightly modifying the logic of a panel drive control unit. An increase in product cost deriving from the adoption of the present invention is negligible.

By employing the arbitrary scanning pulse extension, scan lines for which it is thought effective to extent the pulse duration of a scanning pulse according to a display pattern can be selected, and the pulse duration can be extended. Occurrent of imperfect address discharge can be minimized effectively according to the display pattern.

What is claimed is:

1. A driving method for a plasma display panel, which is adopted for a plasma display panel including a plurality of address lines arranged parallel to one another, a plurality of scan lines arranged perpendicularly to said plurality of address lines and parallel to one another, and a plurality of cells that coincide with intersections between said plurality of address lines and said plurality of scan lines and that are selectively discharged to glow with a signal applied to said plurality of address lines and a signal applied to said plurality of scan lines, wherein:

the pulse duration of a scanning pulse to be applied continually to said plurality of scan lines is different from scan line to scan line.

2. A driving method for a plasma display panel according to claim 1, wherein a scanning pulse having a long pulse duration is applied to a scan line that is scanned previously to a scan line to which a scanning pulse having a short pulse duration is applied.

3. A driving method for a plasma display panel according to claim 2, wherein a scanning pulse having a long pulse duration is applied at least to a scan line that is first scanned.

4. A driving method for a plasma display panel according to claim 3, wherein the ratio of said long pulse duration to said short pulse duration ranges from 1.05 to 4.0.

5. A driving method for a plasma display panel according to claim 4, wherein the ratio of said long pulse duration to said short pulse duration is 2.3.

6. A driving method for a plasma display panel according to claim 1, wherein said pulse duration of a scanning pulse can be set arbitrarily for each display.

7. A driving method for a plasma display panel according to claim 6, wherein said pulse duration of a scanning pulse can be set arbitrarily for each scan line.

8. A driving method for a plasma display panel according to claim 1, comprising:

a cycle that includes: an addressing step of scanning said plurality of scan lines so as to apply a scanning pulse continually, of applying a voltage corresponding to display data to said plurality of address lines along with applications a scanning pulse to the respective scan lines, and of thus accumulating a charge corresponding to display data on cells connected to each scan line; and a sustaining discharge step of applying a sustaining discharge voltage to said plurality of cells and of discharging cells on each of which a given charge is accumulated to allow the cells to glow, is repeated, a probability-of-an addressing discharge failure judging step in which: it is judged on the basis of display data to be displayed during the next cycle prior to the next cycle if each cell has a high probability of an addressing discharge failure;

a line-by-line probability calculating step of calculating a total number of cells each having a high probability of an addressing discharge failure for each scan line; and a long pulse scan line selecting step of selecting a scan line, to which a scanning pulse having a long pulse duration is applied, on the basis of said total number of cells each having a high probability of an addressing discharge failure per scan line; wherein:

at said addressing step within the next cycle, a scanning pulse having a longer pulse duration than a short scanning pulse to be applied to the other scan lines is applied to a scan line selected at said long pulse scan line selecting step.

9. A driving method for a plasma display panel according to claim 8, wherein judging at said probability of an addressing discharge failure judging step if each cell has a high probability of an addressing discharge failure is such that when a cell connected to the same address line and to a scan line to be scanned immediately previously is unlit, a cell concerned is judged to have a high probability of an addressing discharge failure.

10. A driving method for a plasma display panel according to claim 8, wherein judging at said probability of an addressing discharge failure judging step if each cell has a high probability of an addressing discharge failure is such that when a cell concerned is unlit during the immediately previous cycle, the cell is judged to have a high probability of an addressing discharge failure.

11. A driving method for a plasma display panel according to claim 8, wherein judging at said probability of an addressing discharge failure judging step if each cell has a high probability of an addressing discharge failure is such that when a cell connected to the same address line and to a scan line of said plurality of scan line which is scanned immediately previously is unlit, and when a cell concerned is unlit during the immediately previous cycle, the cell concerned is judged to have a high probability of an addressing discharge failure.

12. A driving method for a plasma display panel according to claim 8, wherein at said long pulse scan line selecting step, a given number of scan lines are selected as scan lines, to which a scanning pulse having a long pulse duration is applied, in descending order of total number of cells each having a high probability of an addressing discharge failure, and wherein a long pulse duration and short pulse duration are constant.

13. A driving method for a plasma display panel according to claim 8, wherein said long pulse scan line selecting step includes:

a minimum number-of-cells judging step of judging if a total number of cells each having a high probability of an addressing discharge failure per scan line is larger than or equal to a given value;

a number-of-scan lines judging step of judging if the number of scan lines associated with the total numbers of cells each having a high probability of an addressing discharge failure which are larger than or equal to said given value is larger than or equal to a given value;

a selecting step at which: when it is judged at said number-of-scan lines judging step that the number of scan lines is larger than or equal to said given value, the number of scan lines that is specified by said given value are selected as scan lines, to which a scanning pulse having a long pulse duration is applied, in descending order of total number of cells each having a high probability of an addressing discharge failure, and said given value is regarded as a value specifying the number of long scanning pulses; and when it is judged that the number of scan lines is smaller than or equal to said given value, all scan lines associated with the total numbers of cells each having a high probability of an addressing discharge failure which are larger than or equal to said given value are selected as scan lines to which a scanning pulse having a long pulse duration is applied, and the number of scan lines to which a scanning pulse having a long pulse duration is applied is regarded as a value specifying the number of long scanning pulses; and a pulse duration calculating step at which a quotient of a given permissible time for said addressing step by said number of long scanning pulses is added to said short pulse duration of a scanning pulse in order to calculate said long pulse duration of a scanning pulse.

14. A driving method for a plasma display panel according to claim 8, wherein said long pulse scan line selecting step includes:

a selecting step of selecting scan lines, which are associated with the total numbers of cells each having a high probability of an addressing discharge failure per scan line which are higher than or equal to a given value, as scan lines to which a scanning pulse having a long pulse duration is applied; and a pulse duration calculating step of adding a quotient of a given permissible time for said addressing step by the number of scan lines to which a scanning pulse having a long pulse duration is applied to said short pulse duration of a scanning pulse, and thus calculating said long pulse duration of a scanning pulse.

15. A plasma display, comprising:

a plasma display panel including a plurality of address lines arranged parallel to one another, a plurality of scan lines arranged perpendicularly to said plurality of address lines and parallel to one another, and a plurality of cells that coincide with intersections between said plurality of address lines and said plurality of scan lines and that are selectively discharged to glow with a signal applied to said plurality of address lines and a signal applied to said plurality of scan lines;

a scan driver for scanning said plurality of scan lines so as to continually apply a scanning pulse to said plurality of scan lines;

an address driver for applying a voltage corresponding to display data to said plurality of address lines coincident with one display line during a period during which a scanning pulse is applied continually; and sustaining discharge circuit for applying a sustaining discharge voltage to said plurality of cells and for discharging cells, on each of which a given charge is accumulated, so as to allow the cells to glow, said plasma display further comprising:

a control circuit for controlling said scan driver so that the pulse duration of a scanning pulse will be different from scan line to scan line.

16. A plasma display according to claim 15, wherein said control circuit gives control so that a scanning pulse having a long pulse duration will be applied to a scan line that is scanned previously.

17. A plasma display according to claim 16, wherein said control circuit applies a scanning pulse having a long pulse duration at least to a scan line that is scanned first.

18. A plasma display according to claim 17, wherein the ratio of said long pulse duration to said short pulse duration ranges from 1.05 to 4.0.

19. A plasma display according to claim 18, wherein the ratio of said long pulse duration to said short pulse duration is 2.3.

20. A plasma display according to claim 15, wherein said pulse duration of a scanning pulse can be set arbitrarily for each display.

21. A plasma display according to claim 20, wherein said pulse duration of a scanning pulse can be set arbitrarily for each scan line.

22. A plasma display according to claim 15, further comprising:

a probability of an addressing discharge failure judging circuit for judging on the basis of display data to be displayed during the next cycle prior to the next cycle if each cell has a high probability of an addressing discharge failure;

a line-by-line probability calculating circuit for calculating a total number of cells each having a high probability of an addressing discharge failure for each scan line; and a long pulse scan line selecting circuit for selecting scan lines, to which a scanning pulse having a long pulse duration is applied, on the basis of said total number of cells each having a high probability of an addressing discharge failure per scan line, wherein:

a scanning pulse having a longer pulse duration than a short scanning pulse to be applied to the other scan lines is applied to a scan line selected by said long pulse scan line selecting circuit.

23. A plasma display according to claim 22, wherein said probability-of-an addressing discharge failure judging circuit judges if each cell has a high probability of an addressing discharge failure in such a manner that when a cell connected to the same address line and to a scan line that is scanned immediately previously is unlit, a cell concerned is judged to have a high probability of an addressing discharge failure.

24. A plasma display according to claim 22, wherein said probability-of-an addressing discharge failure judging circuit judges if each cell has a high probability of an addressing discharge failure in such a manner that when a cell concerned is unlit during the immediately previous cycle, the cell is judged to have a high probability of an addressing discharge failure.

25. A plasma display according to claim 22, wherein said probability-of-an addressing discharge failure judging circuit judges if each cell has a high probability of an addressing discharge failure in such a manner that when a cell connected to the same address line and to a scan line of said plurality of scan lines which is scanned immediately previously is unlit, and when a cell concerned is unlit during the immediately previous cycle, the cell concerned is judged to have a high probability of an addressing discharge failure.

26. A plasma display according to claim 22, wherein said long pulse scan line selecting circuit selects a given number of scan lines as scan lines, to which a scanning pulse having a long pulse duration is applied, in descending order of total number of cells each having a high probability of an addressing discharge failure, and wherein said long pulse duration and short pulse duration are constant.

27. A plasma display according to claim 22, wherein said long pulse scan line selecting circuit includes:

a minimum number-of-cells judging circuit for judging if a total number of cells each having a high probability of an addressing discharge failure per scan line is larger than or equal to a given value;

a number-of-scan lines judging circuit for judging if the number of scan lines associated with the total numbers of cells each having a high probability of an addressing discharge failure which are larger than or equal to said given value is larger than or equal to a given value;

a selecting circuit that: when it is judged by said number-of-scan lines judging circuit that the number of scan lines is larger than or equal to said given value, selects the number of scan lines that is specified by said given value as scan lines, to which a scanning pulse having a long pulse duration is applied, in descending order of total number of cells each having a high probability of an addressing discharge failure, and regards said given value as a value specifying the number of long scanning pulses; and when it is judged that the number of scan lines is smaller than or equal to said given value, selects all scan lines, which are associated with the total numbers of cells each having a high probability of an addressing discharge failure which are larger than or equal to said given value, as scan lines to which a scanning pulse having a long pulse duration is applied, and regards the number of scan lines to which a scanning pulse having a long pulse duration is applied as a value specifying the number of long scanning pulses; and a pulse duration calculating circuit for adding a quotient of a given permissible time by said number of long scanning pulses to said short pulse duration of a scanning pulse so as to calculate said long pulse duration of a scanning pulse.

28. A plasma display according to claim 22, wherein said long pulse scan line selecting circuit includes:

a selecting circuit for selecting all scan lines, which are associated with the total numbers of cells each having a high probability of an addressing discharge failure per scan line which are larger than or equal to said given value, as scan lines to which a scanning pulse having a long pulse duration is applied; and a pulse duration calculating circuit for adding a quotient of a given permissible time by the number of scan lines to which a scanning pulse having a long pulse duration is applied to said short pulse duration of a scanning pulse so as to calculate said long pulse duration of a scanning pulse.

29. A plasma display according to claim 15, further comprising a driving waveform ROM that stores a plurality of waveforms of a scanning pulse, wherein said control means applies an address signal used to access a desired waveform of a scanning pulse stored in said driving wave ROM to said driving wave ROM, and produces a scanning pulse on the basis of an output signal of said driving wave ROM.

* * * * *

UNITED STATES PATENT AND TRADEMARK OFFICE

CERTIFICATE OF CORRECTION

PATENT NO. : 6,107,978
DATED : August 22, 2000
INVENTOR(S) : Nagaoka et al.

It is certified that error appears in the above-identified patent and that said Letters Patent is hereby corrected as shown below:

Title page, Item [57],
Line 5 after the word "cells" please insert a comma -- , --, therefor (As stated in Amendment After Notice of Allowance dated February 23, 1999)

Signed and Sealed this

Sixth Day of November, 2001

*Attest:*

Nicholas P. Godici

*Attesting Officer*

NICHOLAS P. GODICI
*Acting Director of the United States Patent and Trademark Office*